US010448699B2

(12) United States Patent
Kohatsu et al.

(10) Patent No.: US 10,448,699 B2
(45) Date of Patent: Oct. 22, 2019

(54) ARTICLE OF FOOTWEAR WITH A TACTILE FEEDBACK SYSTEM

(71) Applicant: NIKE, Inc., Beaverton, OR (US)

(72) Inventors: Shane S. Kohatsu, Portland, OR (US); Christopher S. Cook, Portland, OR (US); Bret Schoolmeester, Banks, OR (US); Matthew R. Pauk, Portland, OR (US); Lee Gibson, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 524 days.

(21) Appl. No.: 14/935,715

(22) Filed: Nov. 9, 2015

(65) Prior Publication Data

US 2017/0127753 A1 May 11, 2017

(51) Int. Cl.

| | |
|---|---|
| ***A43B 7/24*** | (2006.01) |
| ***A43B 13/18*** | (2006.01) |
| ***A43B 23/02*** | (2006.01) |
| ***A43B 7/14*** | (2006.01) |
| ***A43B 19/00*** | (2006.01) |
| ***A43B 23/07*** | (2006.01) |

(52) U.S. Cl.

CPC ..... *A43B 7/24* (2013.01); *A43B 7/142* (2013.01); *A43B 13/187* (2013.01); *A43B 13/188* (2013.01); *A43B 19/00* (2013.01); *A43B 23/022* (2013.01); *A43B 23/028* (2013.01); *A43B 23/0235* (2013.01); *A43B 23/07* (2013.01)

(58) Field of Classification Search

CPC ..... A43B 7/24; A43B 13/12; A43B 13/181; A43B 13/187; A43B 23/0215; A43B 23/026; A43B 23/028; A43B 17/03; C11D 17/0026; F16F 5/00; F16F 13/00; F16F 13/007

See application file for complete search history.

(56) References Cited

U.S. PATENT DOCUMENTS

| | | | |
|---|---|---|---|
| 2,070,116 | A | 2/1937 | Cutillo |
| 2,142,839 | A | 1/1939 | Flint |
| 3,586,003 | A | 6/1971 | Baker |
| 4,670,998 | A | 6/1987 | Pasternak |
| 4,917,105 | A | 4/1990 | Tiitola et al. |
| 5,784,807 | A | 7/1998 | Pagel |
| 5,896,683 | A | 4/1999 | Foxen et al. |
| 6,701,529 | B1 | 3/2004 | Rhoades et al. |
| 6,715,218 | B2 | 4/2004 | Johnson |
| 7,472,496 | B2 | 1/2009 | Potter et al. |
| 7,490,416 | B2 | 2/2009 | Townsend |
| 8,327,560 | B2 | 12/2012 | Berend |
| 8,689,467 | B2 | 4/2014 | Miner |
| 8,776,402 | B2 | 7/2014 | Cromer, Jr. |

(Continued)

FOREIGN PATENT DOCUMENTS

| | | |
|---|---|---|
| CN | 203482951 U | 3/2014 |
| WO | 2009106077 A1 | 9/2009 |

*Primary Examiner* — Sharon M Prange

(74) *Attorney, Agent, or Firm* — Quinn IP Law

(57) ABSTRACT

An article of footwear includes an upper and a sole structure with a cushioning element. The cushioning element can be disposed in the upper and/or the sole structure. The cushioning element is configured to provide tactile feedback to a user during pronation events. The cushioning element can be a dynamically responsive material or shape that exhibits dilatant behavior in response to the application of a force.

19 Claims, 13 Drawing Sheets

(56) References Cited

U.S. PATENT DOCUMENTS

| | | | | |
|---|---|---|---|---|
| 9,125,454 | B2 | 9/2015 | De Roode et al. | |
| 9,259,049 | B2 | 2/2016 | Adami et al. | |
| 2003/0221336 | A1* | 12/2003 | Krstic | A43B 3/0042 36/93 |
| 2004/0221371 | A1* | 11/2004 | Kato | A41B 11/008 2/239 |
| 2011/0014996 | A1 | 1/2011 | Shepherd et al. | |
| 2011/0030245 | A1 | 2/2011 | Truelsen | |
| 2011/0071448 | A1 | 3/2011 | Margiotta | |
| 2011/0099842 | A1 | 5/2011 | Burke et al. | |
| 2011/0258883 | A1* | 10/2011 | Eder | A43B 5/02 36/133 |
| 2011/0277349 | A1 | 11/2011 | Kim | |
| 2012/0260527 | A1 | 10/2012 | Noh | |
| 2014/0325876 | A1 | 11/2014 | Dodge et al. | |
| 2015/0033588 | A1* | 2/2015 | Lai | A43B 5/025 36/133 |
| 2016/0066645 | A1 | 3/2016 | Tanmatsu et al. | |
| 2016/0095389 | A1* | 4/2016 | Minami | A43B 23/026 36/45 |

* cited by examiner

ARTICLE OF FOOTWEAR WITH A TACTILE FEEDBACK SYSTEM

BACKGROUND

The present embodiments relate generally to articles of footwear, and in particular to articles with cushioning provisions and methods of making such articles.

Articles of footwear generally include two primary elements: an upper and a sole member. The upper is often formed from a plurality of material elements (e.g., textiles, polymer sheet layers, foam layers, leather, synthetic leather) that are stitched or adhesively bonded together to form a void on the interior of the footwear for comfortably and securely receiving a foot. More particularly, the upper forms a structure that extends over the instep and toe areas of the foot, along medial and lateral sides of the foot, and around a heel area of the foot. The upper may also incorporate a lacing system to adjust the fit of the footwear, as well as permitting entry and removal of the foot from the void within the upper. In addition, the upper may include a tongue that extends under the lacing system to enhance adjustability and comfort of the footwear, and the upper may incorporate a heel counter.

The sole member is secured to a lower portion of the upper so as to be positioned between the foot and the ground. In athletic footwear, for example, the sole member includes a midsole and an outsole. The various sole components may be formed from a polymer foam material that attenuates ground reaction forces (i.e., provides cushioning) during walking, running, and other ambulatory activities. The sole may also include fluid-filled chambers, plates, moderators, or other elements that further attenuate forces, enhance stability, or influence the motions of the foot, for example.

SUMMARY

In one aspect, the present disclosure is directed to an article of footwear with a cushioning system, the article of footwear comprising an upper, the upper including at least a first layer, where the first layer at least partially forms an interior cavity of the article of footwear. The upper has a longitudinal direction, a lateral direction, a forefoot portion, a heel portion, and a midline, as well as a central axis extending in the longitudinal direction from the forefoot portion to the heel portion. The central axis is approximately aligned with the midline of the article of footwear, and the central axis divides the upper into two opposing sides across the lateral direction. Furthermore, the two sides of the upper include a first side and a second side. The cushioning system has at least a first cushioning element, where the first cushioning element is disposed adjacent to the first layer along the first side of the upper. In addition, the first cushioning element comprises an adjustable thickness in response to the application of a force and the first cushioning element includes a dynamically responsive material that exhibits dilatant behavior in response to an application of the force.

In another aspect, the present disclosure is directed to an article of footwear with a pronation feedback system, where the article of footwear comprises an upper and a sole structure. The pronation feedback system has at least a first cushioning element located adjacent to the upper, where the first cushioning element comprises a substantially pyramidal geometry. Furthermore, at least a portion of the pronation feedback system comprises an adjustable thickness due to the inclusion of the first cushioning element, and the first cushioning element includes a dynamically responsive material that exhibits dilatant behavior in response to an application of a force.

In another aspect, the present disclosure is directed to an article of footwear. The article of footwear includes an upper and a sole structure. The article of footwear comprises a cushioning system configured to provide tactile feedback to a user during pronation. The cushioning system includes a first cushioning element and a second cushioning element. In addition, the first cushioning element is disposed adjacent to the upper, and the second cushioning element is disposed adjacent to the sole structure. Furthermore, the first cushioning element has a first region of adjustable thickness, and the second cushioning element has a second region of adjustable thickness.

Other systems, methods, features, and advantages of the embodiments will be, or will become, apparent to one of ordinary skill in the art upon examination of the following figures and detailed description. It is intended that all such additional systems, methods, features, and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
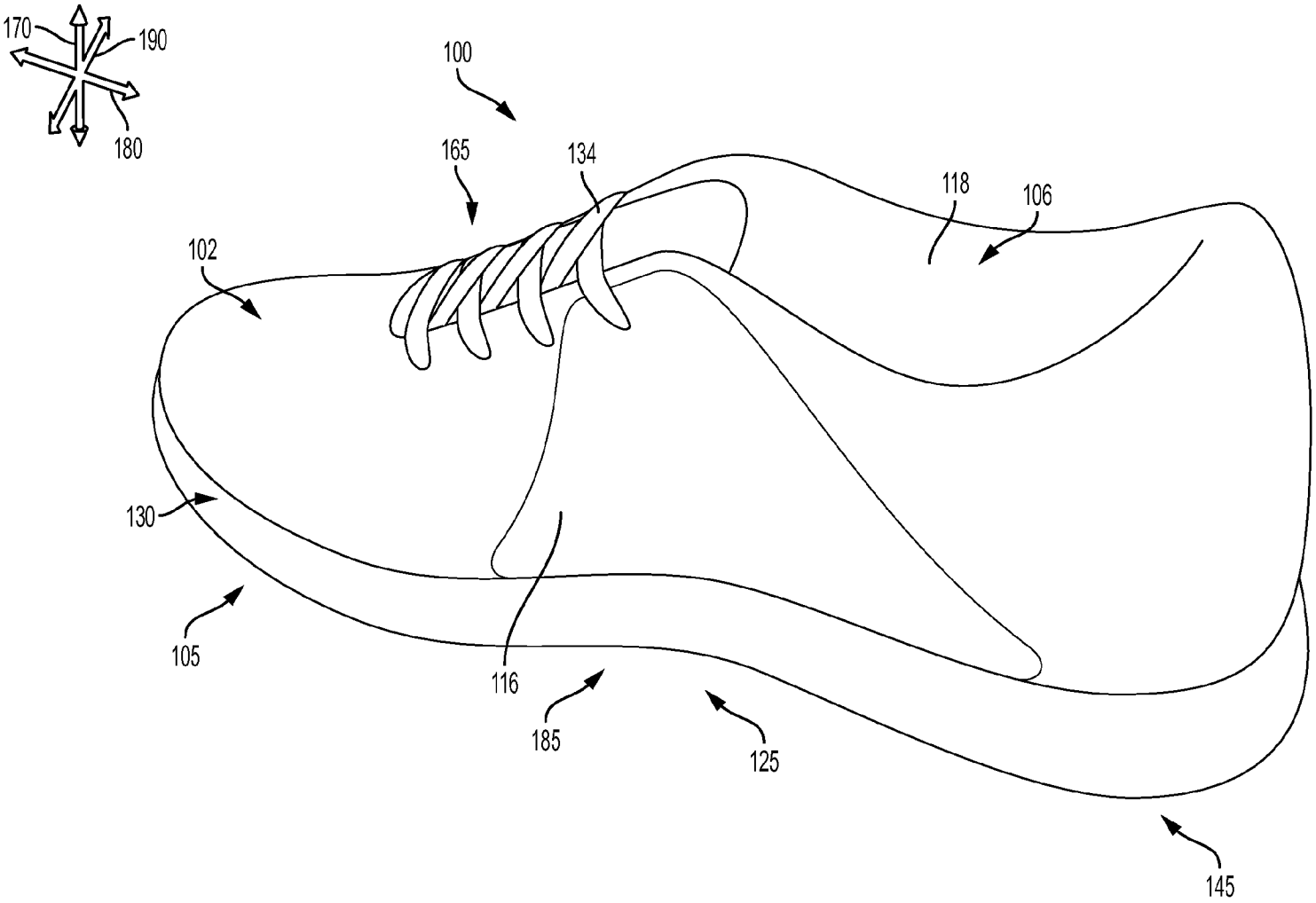
FIG. 1 is an isometric view of an embodiment of an article of footwear with a cushioning system.
Figure 2:
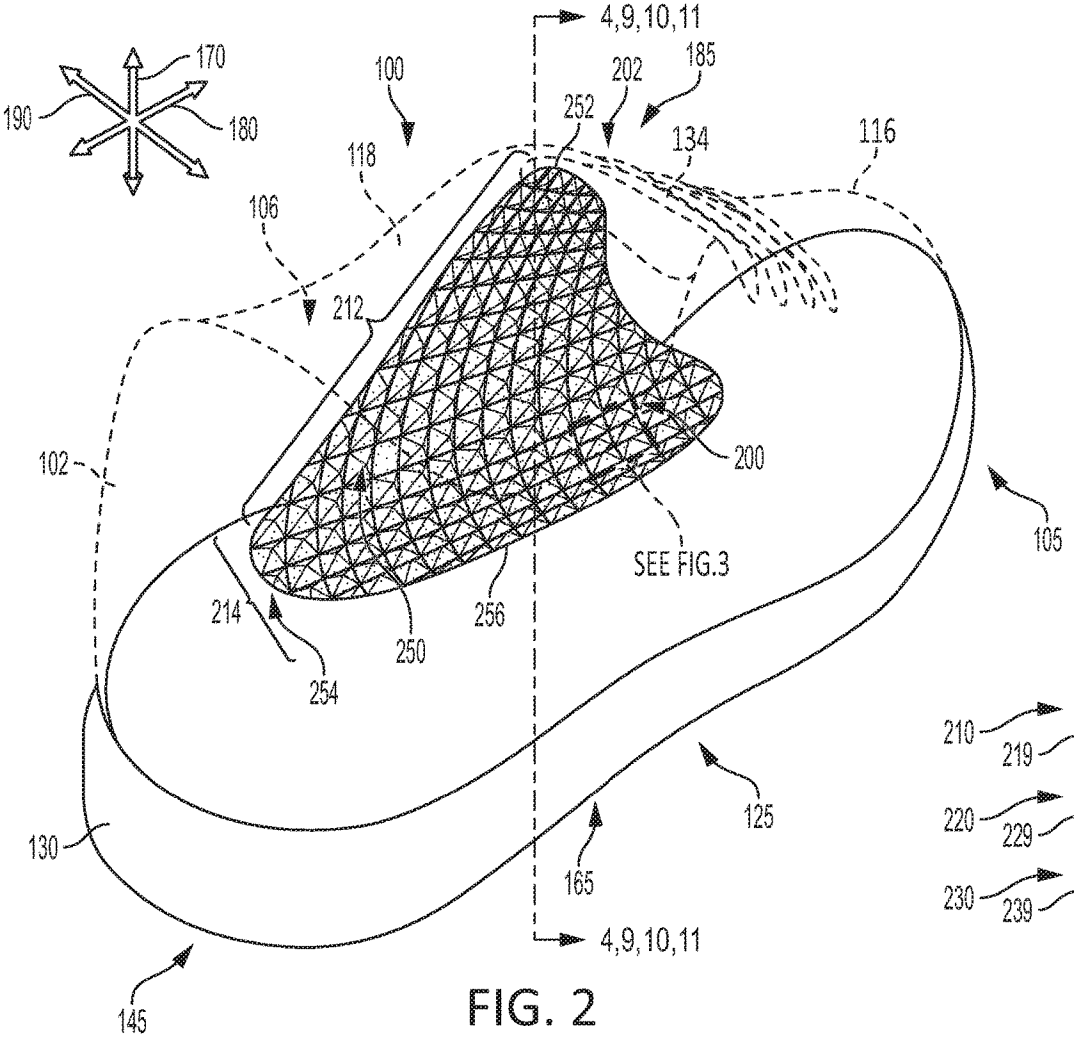
FIG. 2 is an isometric view of an embodiment of an article of footwear with a cushioning system.

FIGS. 1 and 2 depict isometric views of an embodiment of an article of footwear 100. In one embodiment, article of footwear 100 has the form of an athletic shoe. The provisions discussed herein for article of footwear 100 could be incorporated into various other kinds of footwear including, but not limited to, basketball shoes, hiking boots, soccer shoes, football shoes, sneakers, running shoes, cross-training shoes, rugby shoes, rowing shoes, baseball shoes as well as other kinds of shoes. Moreover, in some embodiments, the provisions discussed herein for article of footwear 100 could be incorporated into various other kinds of non-sports-related footwear, including, but not limited to, slippers, sandals, high-heeled footwear, and loafers.

For purposes of clarity, the following detailed description discusses the features of article of footwear 100, also referred to simply as article 100. However, it will be understood that other embodiments may incorporate a corresponding article of footwear (e.g., a right article of footwear when article 100 is a left article of footwear) that may share some, and possibly all, of the features of article 100 described herein and shown in the figures.

As will be discussed in detail further below, in different embodiments, article 100 may include provisions for providing tactile feedback or sensory information to the user. In some embodiments, article 100 may include a cushioning system or dynamic response portion associated with the article. It should be understood that the following figures are for purposes of illustration only, and each of the components described herein may be included or referred to in the description while not illustrated in the figures.

For consistency and convenience, directional adjectives are employed throughout this detailed description corresponding to the illustrated embodiments. The term "longitudinal" as used throughout this detailed description and in the claims refers to a direction extending a length of a component (e.g., an upper or sole component). A longitudinal direction may extend along a longitudinal axis, which itself extends between a forefoot portion and a heel portion of the component. Also, the term "lateral" as used throughout this detailed description and in the claims refers to a direction extending along a width of a component. A lateral direction may extend along a lateral axis, which itself extends between a medial side and a lateral side of a component. Furthermore, the term "vertical" as used throughout this detailed description and in the claims refers to a direction extending along a vertical axis, which itself is generally perpendicular to a lateral axis and a longitudinal axis. For example, in cases where an article is planted flat on a ground surface, a vertical direction may extend from the ground surface upward. This detailed description makes use of these directional adjectives in describing an article and various components of the article, including an upper, a midsole structure, and/or an outer sole structure.

The term "side," as used in this specification and in the claims, refers to any portion of a component facing generally in a lateral, medial, forward, or rearward direction, as opposed to an upward or downward direction. The term "upward" refers to the vertical direction heading away from a ground surface, while the term "downward" refers to the vertical direction heading toward the ground surface. Similarly, the terms "top," "upper," and other similar terms refer to the portion of an object substantially furthest from the ground in a vertical direction, and the terms "bottom," "lower," and other similar terms refer to the portion of an object substantially closest to the ground in a vertical direction.

The "interior" of a shoe refers to space that is occupied by a wearer's foot when the shoe is worn. The "inner side" of a panel or other shoe element refers to the face of that panel or element that is (or will be) oriented toward the shoe interior in a completed shoe. The "outer side" or "exterior" of an element refers to the face of that element that is (or will be) oriented away from the shoe interior in the completed shoe. In some cases, the inner side of an element may have other elements between that inner side and the interior in the completed shoe. Similarly, an outer side of an element may have other elements between that outer side and the space external to the completed shoe. Further, the terms "inward" and "inwardly" shall refer to the direction toward the interior of the shoe, and the terms "outward" and "outwardly" shall refer to the direction toward the exterior of the shoe.

For purposes of this disclosure, the foregoing directional terms, when used in reference to an article of footwear, shall refer to the article of footwear when sitting in an upright position, with the sole facing groundward, that is, as it would be positioned when worn by a wearer standing on a substantially level surface.

In addition, for purposes of this disclosure, the term "fixedly attached" shall refer to two components joined in a manner such that the components may not be readily separated (for example, without destroying one or both of the components). Exemplary modalities of fixed attachment may include joining with permanent adhesive, rivets, stitches, nails, staples, welding or other thermal bonding, or other joining techniques. In addition, two components may be "fixedly attached" by virtue of being integrally formed, for example, in a molding process.

For purposes of this disclosure, the term "removably attached" or "removably inserted" shall refer to the joining of two components or a component and an element in a manner such that the two components are secured together, but may be readily detached from one another. Examples of removable attachment mechanisms may include hook and loop fasteners, friction fit connections, interference fit connections, threaded connectors, cam-locking connectors, compression of one material with another, and other such readily detachable connectors.

Thus, the embodiments may be characterized by various directional adjectives and reference portions. These directions and reference portions may facilitate in describing the portions of an article of footwear. Moreover, these directions and reference portions may also be used in describing subcomponents of an article of footwear (e.g., directions and/or portions of a midsole structure, an outer sole structure, cushioning elements, an upper, or any other components).

For purposes of reference, article 100 may be characterized by a number of different regions or portions. For example, article 100 could include a forefoot portion, a midfoot portion, a heel portion, a vamp portion, and an instep portion. Moreover, the various components of article 100 could likewise comprise corresponding portions. Referring to FIG. 1, article 100 may be divided into forefoot portion 105, midfoot portion 125, and heel portion 145. Forefoot portion 105 may be generally associated with the toes and joints connecting the metatarsals with the phalanges. Midfoot portion 125 may be generally associated with the arch of a foot. Likewise, heel portion 145 may be generally associated with the heel of a foot, including the calcaneus bone.

In addition, article 100 may include a lateral side 165 and a medial side 185. In particular, lateral side 165 and medial side 185 may be opposing sides of article 100. Furthermore, both lateral side 165 and medial side 185 may extend through forefoot portion 105, midfoot portion 125, and heel portion 145.

Referring to FIGS. 1 and 2, for reference purposes, a lateral axis 190 of article 100, and any components related to article 100, may extend between medial side 185 and lateral side 165 of the foot. Additionally, in some embodiments, longitudinal axis 180 may extend from forefoot portion 105 to a heel portion 145. It will be understood that each of these directional adjectives may also be applied to individual components of an article of footwear, such as an upper and/or a sole member. In addition, a vertical axis 170 refers to the axis perpendicular to a horizontal surface defined by longitudinal axis 180 and lateral axis 190.

FIGS. 1-2 illustrate various features and components of article of footwear 100, including an upper 102 and a sole structure 130. FIG. 1 provides an isometric medial view of an embodiment of the exterior of article 100. FIG. 2 provides an isometric lateral view of the same article 100, where a portion of the upper is illustrated in dotted line to expose the interior of article 100.

Depending on the material of upper 102, in some embodiments, upper 102 may be configured to stretch fit over a foot without the need for additional fasteners. However, in other embodiments, the use of one or more fasteners may allow upper 102 to enlarge or tighten over a foot and/or provide the needed amount of tension to keep article 100 on the foot. For example, in some embodiments, a lace 134 can extend through various apertures or other securing elements and permit the wearer to modify the dimensions of upper 102 to accommodate the proportions of the foot. More particularly, lace 134 may permit the wearer to tighten portions of upper 102 around the foot, and lace 134 can permit the wearer to loosen upper 102 to facilitate entry and removal of the foot from article 100. In alternative embodiments, upper 102 may include other lace-receiving elements, such as loops, eyelets, and D-rings. In addition, upper 102 may include a tongue in some embodiments. In other embodiments, there may be other types of fasteners such as straps, cords, clips, or other fastening mechanisms.

Furthermore, in some embodiments, sole structure 130 may be configured to provide traction for article 100. Thus, in different embodiments, traction elements may be included in sole structure 130. In addition to providing traction, sole structure 130 may attenuate ground reaction forces when compressed between the foot and the ground during walking, running, pushing, or other ambulatory activities. The configuration of sole structure 130 may vary significantly in different embodiments to include a variety of conventional or nonconventional structures. In some embodiments, the configuration of sole structure 130 can be configured according to one or more types of surfaces on which sole structure 130 may be used. Examples of surfaces include, but are not limited to, natural turf, synthetic turf, dirt, hardwood flooring, skims, wood, plates, footboards, boat ramps, as well as other surfaces.

The various portions of sole structure 130 may be formed from a variety of materials. For example, sole structure 130 may include a compressible polymer foam element (e.g., polyurethane or ethylvinylacetate foam) that attenuates ground reaction forces (i.e., provides cushioning) when compressed between the foot and the ground during walking, running, or other ambulatory activities. In further configurations, sole structure 130 may incorporate fluid-filled chambers, plates, moderators, or other elements that further attenuate forces, enhance stability, or influence the motions of the foot. Furthermore, other portions of sole structure 130, such as an outsole, can be formed from a wear-resistant rubber material that is textured to impart traction. It should be understood that the embodiments herein depict a configuration for sole structure 130 as an example of a sole structure that may be used in connection with upper 102, and a variety of other conventional or nonconventional configurations for sole structure 130 may also be utilized. Accordingly, the structure and features of sole structure 130 or any sole structure utilized with upper 102 may vary considerably.

Sole structure 130 is secured to upper 102 and extends between a foot and the ground when article 100 is worn. In different embodiments, sole structure 130 may include different components. For example, sole structure 130 may include an outsole. Sole structure 130 may further include a midsole and/or an insole. In some embodiments, one or more of these components may be optional. In addition, sole structure 130 may include components or portions that extend toward and/or attach to a portion of upper 102. Such components may provide additional support and compressive strength to article 100.

In different embodiments, upper 102 may be joined to sole structure 130 and define an interior cavity 106 designed to receive a wearer's foot. In some embodiments, upper 102 includes a mouth opening that provides access for the foot into interior cavity 106 of upper 102.

Upper 102 may generally incorporate various provisions associated with uppers. Upper 102 may also be characterized by one or more layers disposed adjacent to one another. In some embodiments, each layer of upper 102 can be configured to provide various degrees of cushioning, tension, ventilation, shock absorption, energy return, support, as well as possibly other provisions.

In some embodiments, upper 102 may include an inner layer and an outer layer. For example, in one embodiment, article 100 includes a first layer 116 and a second layer 118. First layer 116 may comprise at least a portion of the outer or exposed surface of upper 102. In some embodiments, first layer 116 may be disposed over or joined to portions of second layer 118. In some embodiments, second layer 118 may comprise the opposing side or portion of upper 102 relative to first layer 116. In other words, first layer 116 and second layer 118 may represent two opposing sides of an upper. In one embodiment, first layer 116 and second layer 118 can be disposed adjacent to one another. In another embodiment, first layer 116 and second layer 118 can include one or more materials disposed between the two layers. In some cases, this filler material can add resilience and/or cushioning to the upper.

In some embodiments, first layer 116 has a greater stiffness than second layer 118, though in other embodiments, the stiffness of second layer 118 may be greater or substantially similar to the stiffness of first layer 116. In one embodiment, first layer 116 may be substantially water resistant. Furthermore, in some embodiments, portions of first layer 116 may be either substantially opaque, translucent, or generally clear (i.e., transparent).

Second layer 118 may be disposed closest to a foot when article 100 is worn by a user. In some embodiments, second layer 118 can serve as a sockliner or a bootie. In another embodiment, second layer 118 can comprise the most rigid portion of upper 102. In one embodiment, second layer 118 has a smaller thickness than other layers of upper 102.

In different embodiments, there may be additional layers. For example, there may be a third layer that is disposed adjacent to second layer 118, and is closest to a foot when article 100 is worn by a user. Thus, one or more additional layers can be included to define interior cavity 106 in some embodiments. In other embodiments, additional layers may be included between first layer 116 and second layer 118, increasing the thickness of the upper.

In different embodiments, each of the materials that may comprise the layer(s) of upper 102 can include various properties. The various portions of upper 102 may be formed from one or more of a plurality of material elements (e.g., textiles, polymer sheets, foam layers, leather, synthetic leather, knitted fabrics, etc.) that are stitched together or otherwise laid or disposed adjacent to one another to form upper 102. Other materials that could be used in various embodiments include, but are not limited to, expanded rubber, foam rubber, various kinds of foams, polyurethane, nylon, Gore-Tex, leather, plastic, textiles, as well as possibly other materials. Other parts of upper 102 may be made from any of a plurality of materials or combination of materials, such as leather, leather-like materials, polymer materials, plastic materials, and textile fabrics and materials.

In addition, each of the layers comprising upper 102 may be formed from any generally two-dimensional material. As utilized with respect to the present invention, the term "two-dimensional material," or variants thereof, is intended to encompass generally flat materials exhibiting a length and a width that are substantially greater than a thickness. Accordingly, suitable materials for the layers of the upper (e.g., first layer 116 and/or second layer 118) include various textiles, polymer sheets, or combinations of textiles and polymer sheets, for example. Textiles are generally manufactured from fibers, filaments, or yarns that are, for example, either (a) produced directly from webs of fibers by bonding, fusing, or interlocking to construct non-woven fabrics and felts or (b) formed through a mechanical manipulation of yarn to produce a woven or knitted fabric. The textiles may incorporate fibers that are arranged to impart one-directional stretch or multidirectional stretch, and the textiles may include coatings that form a breathable and water-resistant barrier, for example. The polymer sheets may be extruded, rolled, or otherwise formed from a polymer material to exhibit a generally flat aspect. Two-dimensional materials may also encompass laminated or otherwise layered materials that include two or more layers of textiles, polymer sheets, or combinations of textiles and polymer sheets. In addition to textiles and polymer sheets, other two-dimensional materials may be utilized for upper 102. Although two-dimensional materials may have smooth or generally untextured surfaces, some two-dimensional materials will exhibit textures or other surface characteristics, such as dimpling, protrusions, ribs, or various patterns, for example. Despite the presence of surface characteristics, two-dimensional materials remain generally flat and exhibit a length and a width that are substantially greater than a thickness. In some configurations, mesh materials or perforated materials may be utilized for the upper. For example, first layer 116 and/or second layer 118 (or other additional layers) may comprise a mesh material, which may impart greater breathability or air permeability to article 100.

Referring now again to FIG. 2, it can be seen that in some embodiments, article 100 can include various structural components that are disposed within or associated with upper 102 and/or sole structure 130. In some embodiments, article 100 can include a first dynamic cushioning system ("first cushioning system") 250. For purposes of this disclosure a dynamic cushioning system is a system associated with article 100 that can provide a user with various tactile-sensory feedback and/or information regarding the motion and/or position of the user's foot as it is positioned within the article.

In some embodiments, first cushioning system 250 may comprise one or more cushioning elements. A cushioning element for purposes of this disclosure can include provisions for increasing flexibility, fit, comfort, and/or stability during deformation or use of the cushioning element or the article incorporating the cushioning element. Some of the embodiments of cushioning elements as disclosed herein may be utilized in various articles of apparel. In one embodiment, the cushioning elements may be used in an article of footwear. For example, as discussed in further detail below, in one embodiment, portions of a sole structure or sole member may incorporate or otherwise include a cushioning element. In some embodiments, one or more cushioning elements may be disposed between first layer 116 and second layer 118. In some embodiments, a cushioning element can be disposed at least partially between first layer 116 and second layer 118 of upper 102. In another embodiment, one or more cushioning elements may be embedded or fixedly attached to a portion of first layer 116 and/or second layer 118. In one embodiment, a cushioning element can be fixedly attached to the surface of second layer 118. In some embodiments, a portion of a cushioning element can be joined to upper 102, and a portion of the cushioning element may protrude into or extend inward within interior cavity 106 of upper 102.

In FIG. 2, a plurality of cushioning elements 200 are shown. In some embodiments, two or more cushioning elements 200 may be arranged adjacent to and/or contiguous with one another. For example, as shown in FIG. 2, cushioning elements 200 are arranged in a manner similar to a grid. In some embodiments, cushioning elements 200 may be configured to form a substantially continuous array of cushioning elements, which can comprise a first cushioning system 250. However, it should be understood that in other embodiments, cushioning elements 200 may be arranged apart from or spaced from one another. In some cases, cushioning elements 200 can be spaced apart and disposed along various regions of upper 102 and/or sole structure 130.

Furthermore, in different embodiments, first cushioning system 250 may be disposed along and/or through multiple portions of upper 102. In FIG. 2, cushioning elements 200 are arranged such that they are disposed along medial side 185 of upper 102. Cushioning elements 200 can also be disposed along and/or through multiple portions of sole structure 130 in some embodiments. In FIG. 2, the arrangement of cushioning elements 200 extend from medial side 185 toward lateral side 165 of sole structure 130. Thus, for purposes of reference, first cushioning system 250 may be understood to include a first portion 212 of cushioning elements that are associated with or disposed adjacent to upper 102 and a second portion 214 of cushioning elements that are associated with or disposed adjacent to sole structure 130. In some embodiments, first portion 212 and second portion 214 may be separate portions. However, in other embodiments, first portion 212 and second portion 214 may be substantially continuous (as shown in FIG. 2). In addition, for purposes of reference, first cushioning system 250 has a first end 252 near a lacing region 202; an intermediate portion 254 where first portion 212 and second portion 214 join; and a second end 256 associated with lateral side 165 of sole structure 130.

In some embodiments, the dimensions of first cushioning system 250 can vary through different portions of article 100. In one embodiment, there may be a fewer or a greater number of cushioning elements 200 in some regions relative to other regions of an article. In another embodiment, the size of individual cushioning elements may be larger (or smaller) in some regions relative to other regions. For example, first portion 212 of the system begins at first end 252 and widens as it approaches intermediate portion 254. In other words, the width of first cushioning system 250 near lacing region 202 is narrower than the width of first cushioning system 250 near sole structure 130 on medial side 185. In some cases, this is due to a fewer number of cushioning elements 200 being included along first end 252 relative to the number of cushioning elements 200 arranged near intermediate portion 254, as shown in FIG. 2. In other embodiments, this may be due to the size (e.g., the area or volume) of the cushioning elements near first end 252 being larger relative to those near intermediate portion 254. In some cases, both the size and number of cushioning elements 200 may be adjusted to increase or decrease the size or adjust the shape of first cushioning system 250 in a particular region.

Similarly, in the embodiment of FIG. 2, second portion 214 begins at second end 256 and widens as it approaches intermediate portion 254 of sole structure 130. In other words, the width of first cushioning system 250 near second end 256 is narrower than the width of first cushioning system 250 near sole structure 130 on medial side 185. In some cases, this is due to a fewer number of cushioning elements 200 being included along second end 256 relative to the number of cushioning elements 200 that are included near intermediate portion 254, as shown in FIG. 2. In other embodiments, this may be due to the size (e.g., the area or volume) of the cushioning elements near second end 256 being larger relative to those located proximate to intermediate portion 254. In some cases, both the size and number of cushioning elements 200 may be adjusted to increase or decrease the size or adjust the shape of first cushioning system 250 in a particular region.

In some embodiments, the overall shape of first cushioning system 250 (i.e., the shape associated with the perimeter of first cushioning system 250) may be either regular or irregular. In FIG. 2 for example, the grid arrangement of first cushioning system 250 provides a generally teardrop-like shape that is substantially bent along intermediate portion 254. In other embodiments, cushioning elements 200 may be arranged to form any shape or design throughout article 100.

Figure 3:
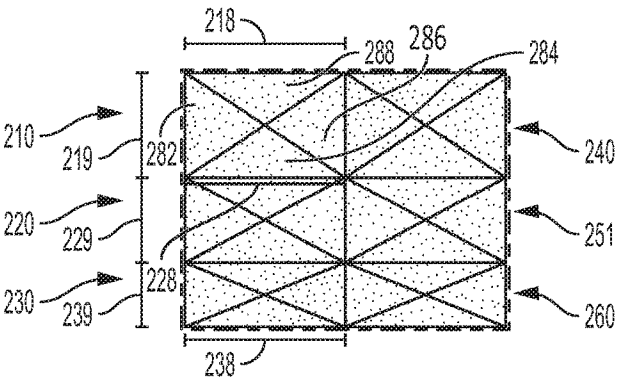
FIG. 3 is a view of an embodiment of a portion of a cushioning system.

The magnified view of first cushioning system 250 shown in FIG. 3 depicts an embodiment of a first cushioning element ("first element") 210, a second cushioning element ("second element") 220, a third cushioning element ("third element") 230, a fourth cushioning element ("fourth element") 240, a fifth cushioning element ("fifth element") 251, and a sixth cushioning element ("sixth element") 260. In FIG. 3, first element 210, second element 220, and third element 230 comprise a first column, and fourth element 240, fifth element 251, and sixth element 260 comprise a second column.

As noted above, in different embodiments, the sizes of two or more cushioning elements 200 may vary. In some embodiments, the volume of one cushioning element can be larger than the volume of another cushioning element. In some embodiments, the dimensions of one cushioning element can be larger than or vary from the dimensions of another cushioning element. For example, in FIG. 3, first element 210 has a first length 218 and a first width 219, second element 220 has a second length 228 and a second width 229, and third element 230 has a third length 238 and a third width 239. In some embodiments, first length 218, second length 228, and third length 238 may be substantially similar (as shown in FIG. 3). However, in other embodiments, two or more of first length 218, second length 228, and third length 238 may differ such that the length of one cushioning element is greater than the length of another cushioning element. Similarly, in some embodiments, two or more of first width 219, second width 229, and third width 239 may be substantially similar. However, in other embodiments, first width 219, second width 229, and third width 239 may differ such that the width of one cushioning element is greater than the width of another cushioning element. As shown in FIG. 3, first width 219 is greater than second width 229. In addition, second width 229 is greater than third width 239. Thus, in some cases, the dimensions of two or more cushioning elements can differ.

In different embodiments, cushioning elements may comprise any three-dimensional shape or geometry, including regular or irregular shapes. For example, cushioning elements may be substantially flat or narrow, and/or relatively thick or wide. The geometry and dimensions of a cushioning element can be configured for the application or exercise in which the article will be used. For illustrative purposes, in FIGS. 2-6, cushioning elements have a generally pyramidal three-dimensional shape.

However, in other embodiments, cushioning elements 200 may comprise a square, round, triangular, oblong, elliptical, hexagonal, pentagonal, or star shape, or any other regular or irregular geometry. Thus, in some cases, the cross-sectional shape of cushioning elements 200 may similarly range from square, round, triangular, pyramidal, oblong, elliptical, hexagonal, pentagonal, or star shape, or any other regular or irregular shape. In FIG. 3, each of first element 210, second element 220, third element 230, fourth element 240, fifth element 251, and sixth element 260 includes a substantially pyramidal geometry.

In some embodiments, one or more elements can comprise multiple faces angled "upward" toward interior cavity 106, as well as a base (shown in FIG. 5) that is associated with the "bottom" of the pyramidal cushioning element. In FIG. 3, for example, first element 210 includes a first face 282, a second face 284, a third face 286, and a fourth face 288. Each face may be joined along one side or edge to an adjacent face, forming a substantially continuous three-dimensional shape. As shown here, each face is approximately triangular in shape. However, it should be understood that other embodiments can have a fewer or greater number of faces, and that the cushioning elements and the different regions of cushioning elements shown herein are for illustrative purposes only. In other embodiments, the cushioning elements may include any contour, and may be any size, shape, thickness, or dimension, including regular and irregular shapes. Furthermore, each face may be substantially similar to another face on a cushioning element, or they may differ in shape or area.

In FIG. 3, first element 210 has a triangular cross-section along a plane roughly aligned with vertical axis 170, and a rectangular cross-section along a plane roughly aligned with a horizontal axis (i.e., lateral axis 190 or longitudinal axis 180). However, it should be understood that references to these shapes are approximate. For example, various portions of each cushioning element may be substantially curved in some embodiments. In other embodiments, cushioning elements can be substantially linear or straight.

It should be understood that the various portions can differ from that shown here and are for reference purposes only. Thus, cushioning elements 200 can include any length from nearly zero to nearly the entire length, width, or height of first cushioning system 250 (including a diagonal length). In cases where the cushioning element varies in geometry from the generally pyramidal shape shown in FIGS. 2-6, cushioning elements 200 can be formed such that they extend in any range up to the maximum length, thickness, breadth, or width associated with the region comprising first cushioning system 250. Some examples will be discussed further below with respect to FIGS. 12-17.

Figure 4:
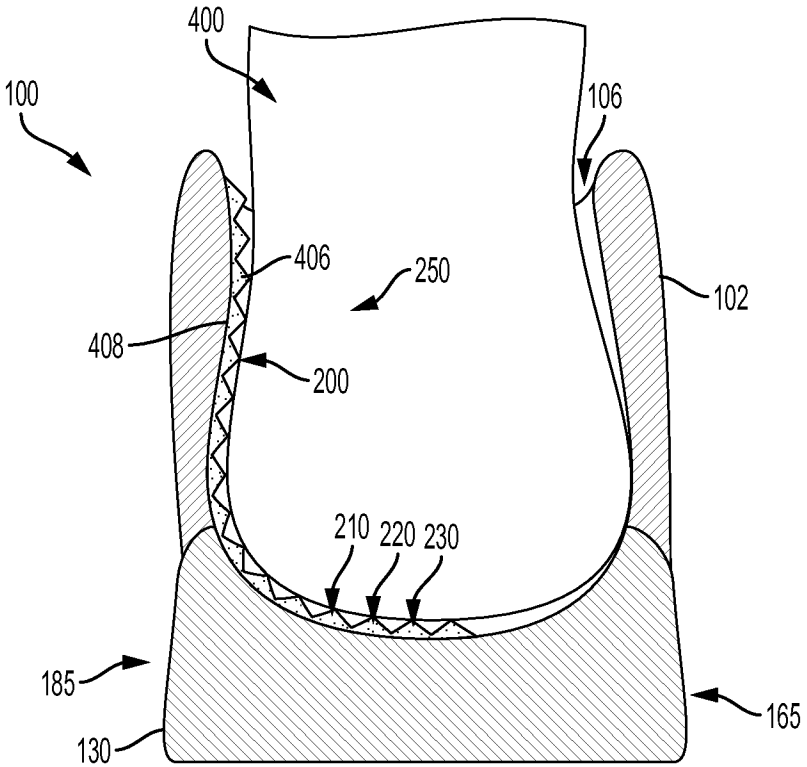
FIG. 4 is a cross-sectional view of an embodiment of an article of footwear with a cushioning system.

Referring now to FIG. 4, a cross section of an embodiment of first cushioning system 250 is depicted with a foot 400. As noted earlier, first cushioning system 250 may extend downward from a lacing region of article 100 in some embodiments. In FIG. 4, the cross section reveals one example of the triangular shapes of first element 210, second element 220, and third element 230, as well as other neighboring cushioning elements.

In some embodiments, first cushioning system 250 can have various surfaces associated with the system. Each surface may be formed by the corresponding surfaces of one or more cushioning elements 200. In FIG. 4, it can be seen that first cushioning system 250 may include a first surface 406 and a second surface 408. In one embodiment, first surface 406 can be disposed further inward, toward interior cavity 106, and second surface 408 can be disposed further outward, toward the exterior of upper 102. Furthermore, in FIG. 4, the cross section depicts second surface 408 as substantially continuous, due to the contiguous, grid arrangement of cushioning elements 200. first surface 406 is also substantially continuous in this embodiment, though it is not as flat as second surface 408.

The texture of each surface may vary in different embodiments. In some embodiments, first surface 406 and/or second surface 408 may be irregular, bumpy, or otherwise uneven. In other embodiments, first surface 406 and/or second surface 408 may be substantially smooth. Furthermore, the cross-sectional profile of each surface may be different. For example, in FIG. 4, first surface 406 includes a recurring up-and-down undulation, while second surface 408 curves along more smoothly to generally follow the overall curvature of upper 102 and sole structure 130. In some cases, this is due to the shape of each cushioning element. In FIG. 4, as first element 210, second element 220, and third element 230 (as well as the other neighboring cushioning elements) each have generally triangular cross-sectional shapes, the profile of first surface 406 includes a repeating arrangement of pointed curves, triangular or tapered peaks, or sharp hills. Furthermore, because second surface 408 is associated with the substantially smooth and nearly flat bottom side of cushioning elements (see FIG. 5), second surface 408 may be smoother than first surface 406. In other embodiments, the profile of each surface may vary from what is depicted here. In addition, in some embodiments, the profile associated with a surface may be adjustable or deformed during the use of the article, as will be discussed further below with respect to FIGS. 6 and 9-11.

Figure 5:
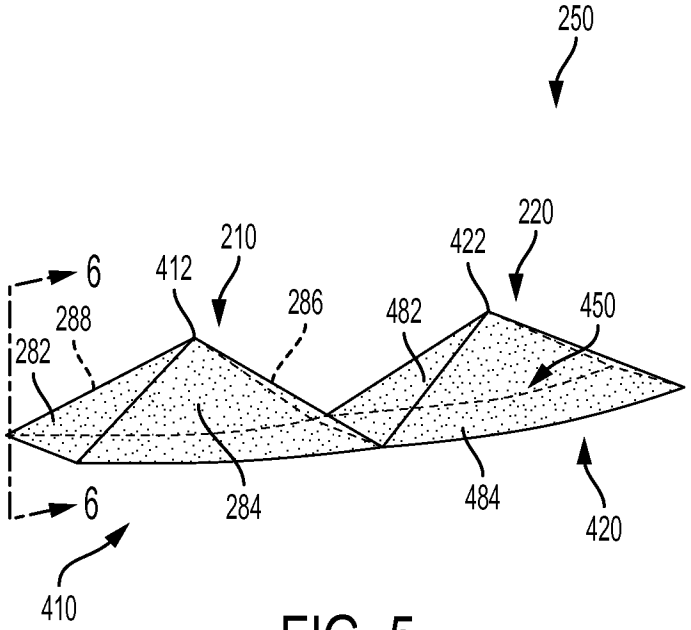
FIG. 5 is an isometric view of an embodiment of two cushioning elements.

Referring now to FIG. 5, an isometric illustration of a portion of first cushioning system 250 is shown, including first element 210 and second element 220. As mentioned earlier with respect to FIGS. 2-3, each element may include multiple faces 450. In FIG. 5, first face 282 and second face 284 of first element 210 can be seen, as well as a fifth face 482 and sixth face 484 of second element 220. Furthermore, third face 286 and fourth face 288 of first element 210 are depicted through the use of dotted lines. Thus, it can be seen that each of the four faces comprising first surface 406 of first element 210 are angled to face upward from a first base 410, tapering until they meet at a tapered first apex 412 of first element 210. First apex 412 may be generally pointed and/or include a tip, though in other embodiments, first apex 412 may be substantially rounded or flattened.

In some embodiments, first base 410 may be generally flat and/or linear. However, in other embodiments, as shown in FIG. 5, first base 410 can include a gentle concave or convex curvature that can correspond to the curvature of the portion of the article to which it is adjoining, while remaining substantially flat. In different embodiments, first base 410 may be irregular or include other non-flat portions. In some embodiments, an adjacent cushioning element may include similar features. For example, second element 220 also extends upward from a second base 420 toward a tapered second apex 422. In addition, as noted earlier, in different embodiments, the dimensions and shape of each cushioning element may vary with respect to one another.

In different embodiments, the materials comprising the cushioning elements of a cushioning system can be configured to respond with a particular pattern of behavior. In some cases, the pattern of behavior can convey information, or feedback, to an individual. In some of the embodiments, when a particular force or pressure is exerted against a cushioning element, it may exhibit a particular response or behavior. In some embodiments, a cushioning system may be configured to respond with a behavior that corresponds to the rate or speed with which the force is exerted. In another embodiment, the behavior may correspond to the magnitude and/or direction of the force. For example, in some embodiments, the cushioning element may comprise a thickness that changes upon the application of a force. In one embodiment, a first force may elicit a greater change in thickness than a second, different force. In another embodiment, a first force may elicit a lesser change in thickness than a second, different force. In other words, the thickness of the cushioning element may be adjustable when a force is applied. In one embodiment, a first force that is greater than a second force may compress and decrease the thickness of the cushioning element more than the second force. However, as will be discussed below, in other embodiments, a first force that is less than a second force may compress and decrease the thickness of the cushioning element more than the second force.

Furthermore, the overall profile and geometry of at least a portion of the cushioning system may be adjustable in different embodiments. For example, in some embodiments, the cushioning elements may comprise a geometry or cross-sectional profile that changes upon the application of a force. In one embodiment, a first force may elicit a greater change in geometry than a second, different force. In another embodiment, a first force may elicit a lesser change in geometry than a second, different force. In other words, the geometry or profile of the cushioning element may be adjustable when a force is applied. In one embodiment, a first force that is greater than a second force may deform the geometry of the cushioning element more than the second force. However, as will be discussed below, in other embodiments, a first force that is less than a second force may deform the geometry of the cushioning element more than the second force.

In different embodiments, various types of materials can be included in the cushioning elements described herein in order to provide properties as described herein. In some embodiments, some materials with specific behavior and cushioning properties can be used. In some embodiments, one or more dynamically responsive or non-Newtonian materials can be utilized in cushioning elements. For purposes of this disclosure, a "non-Newtonian material" is a material, often a fluid or gel or gel-like solid, in which the stiffness of the material changes with the applied strain rate. This is in contrast to Newtonian materials, which behave linearly in response to strain rate so that their stiffness is constant over a wide range of strain rates. "Newtonian materials" as we define them for the purposes of this disclosure, are compliant shock attenuating materials with predominately linear load displacement characteristics. Newtonian materials may demonstrate some non-linear properties in imitation of non-Newtonian properties, but they are generally linear in their load displacement behavior.

Thus, non-Newtonian materials are dynamically responsive materials that exhibit a non-linear stiffness in response to a strain rate. In other words, a non-Newtonian material can be flexible and compressible during periods of a first load such as a user walking or standing. In response to an increased strain from, for example, an increased load caused by the same user running, the material can stiffen and have reduced or no compressibility. Accordingly, a cushioning element comprising a non-Newtonian material can be used to provide cushioning and comfort during lower impact activities. However, when a user engages in higher impact activity, the non-Newtonian nature of the cushioning element can provide increased stiffness for more impact resistance and tactile feedback.

In some embodiments, the non-Newtonian material can have a compressibility that changes in response to the rate of force applied, such that a lower application of force may result in greater compression of the region of adjustable thickness of the cushioning element, resulting in a thinner material. Furthermore, a greater application of force can result in less compression of the region of adjustable thickness of the cushioning element, resulting in a thicker material. Similarly, in some embodiments, the non-Newtonian material can allow the geometry or profile of the cushioning element to deform in response to the rate of force applied, such that a lower application of force may result in greater deformation, and a higher application of force can result in less deformation of the cushioning element.

For purposes of this disclosure, dynamically responsive materials include non-Newtonian materials, where non-Newtonian materials refer generally a fluid, foam, fabric, gel, or gel-like solid, in which the stiffness of the material changes with the applied strain rate. In some embodiments, non-Newtonian materials may comprise polymers, such as silicone-based polymers, which may be formed using siloxane, or poly-vinyl alcohol, lubricant materials such as oil, waxes, or grease, a filler-type material used in combination with one or more of a polymeric material and lubricant, and/or a type of commercially available non-Newtonian materials such as D3O ST®, D3O XT®, D3O Shock+®, D3O Aero®, D3O Decell®, D3O Lite®, D3O Milicell®, D3O Pulse®, D3O Smart Skin®, DEFLEXION™ DOW Corning Active Protection System, Sofshell ID Flex Technology™, PORON products XRD® materials, and other materials.

Materials with non-Newtonian properties for purposes of this disclosure may also be dilatant or shear thickening. Dilatant materials demonstrate significant increases in stiffness as the loading rate increases. In some embodiments, dilatant materials include, but are not limited to, polyborosiloxanes, rheopectic materials, thixotropic materials, pseudoplastics, Bingham plastic materials, anelastic materials, yield pseudoplastic, yield dilatant materials, and Kelvin materials. In some embodiments, these and other materials may be included in a system to elicit biomechanically-defined attenuation behavior in response to a force. In another embodiment, one or more shear thickening or dilatant materials may be utilized within the cushioning element or system to increase stiffness in proportion to the load or force. Thus, in one embodiment, first cushioning system 250 may provide a shock attenuation system that progressively increases in stiffness in proportion to a force. For example, first cushioning system 250 may include materials that are pliable, yielding, or otherwise "softer" in unstressed, low impact, or in response to relatively low forces. However, in a stressed state such as during a higher impact or in response to greater forces, the cushioning elements can lose their pliability and become increasingly viscous or stiff as the rate of shear strain increases.

Furthermore, in some embodiments, the maximum thickness of first element 210 may be adjusted by using a material that varies in thickness in response to the rate of force applied. Such material that varies in thickness in response to the rate of force applied can exhibit non-Newtonian or dilatant characteristics as described above.

In different embodiments, the dynamically responsive material(s) can be encapsulated or otherwise contained such that its lateral expansion is limited. An encapsulating material can have a high degree of elasticity and resilience such that it does not interfere with or mask the physical properties of the dynamically responsive material. Some encapsulating materials that may be used include, but are not limited to, encapsulating film envelopes; sheets of plastic film or plastic film envelopes; polyurethane film envelopes; envelopes or coatings made from resilient butyl rubber, nitrile rubber, latex, or other elastomers; polymer based envelopes; woven fabric envelopes, various coatings created by dipping or spraying; and other such materials known within the art.

Figure 6:
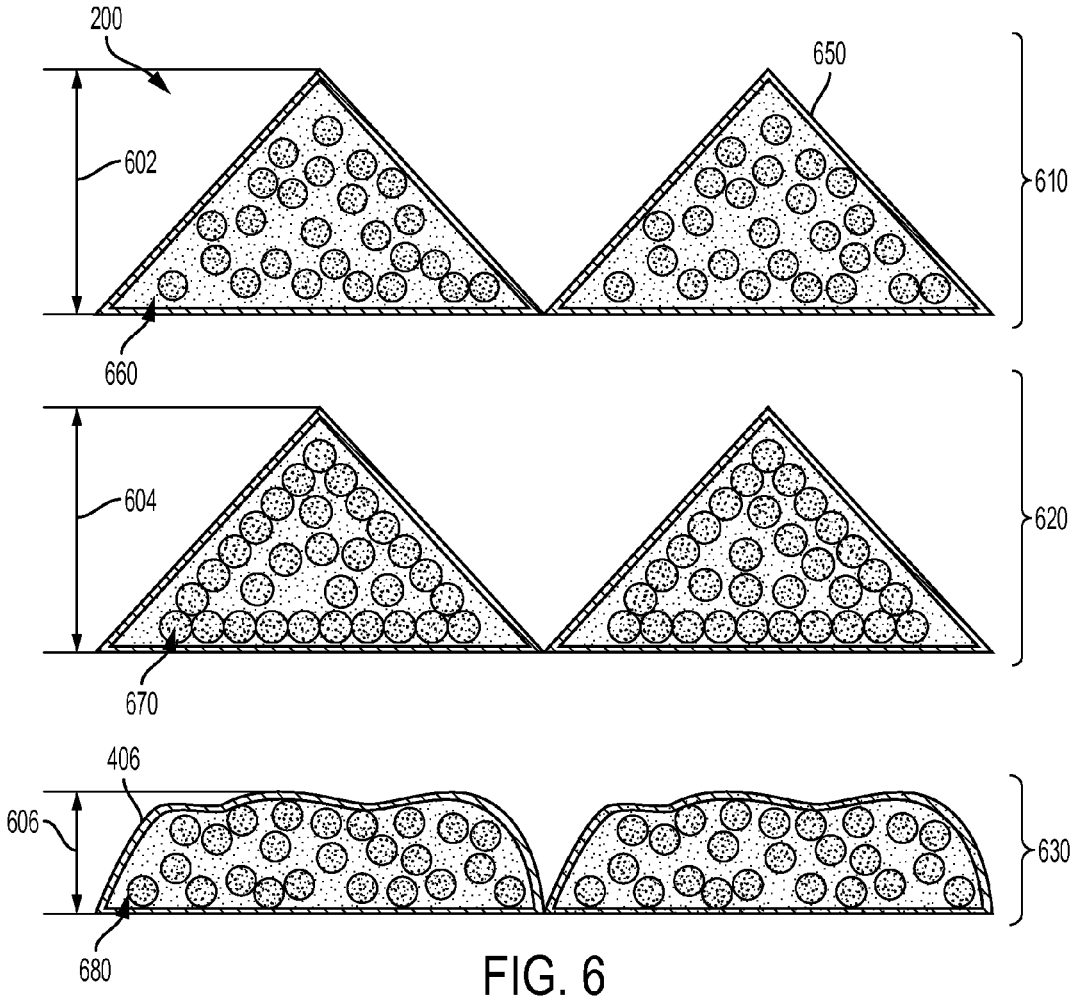
FIG. 6 is a schematic view of an embodiment of two cushioning elements in various response states.

Referring now to FIG. 6, different response states are illustrated for some cushioning elements 200. For example, FIG. 6 includes a first response state 610, a second response state 620, and a third response state 630. It should be understood that each response state is provided for illustrative purposes only, and that in other embodiments, the states may differ from those shown herein. In FIG. 6, first response state 610 represents an initial state in which no external force is being applied to cushioning elements 200. For descriptive purposes, a schematic representation of the non-Newtonian or dilatant material comprising cushioning elements 200 is also illustrated. In first response state 610, a first set 660 of dilatant material elements is represented. First set 660 is generally in a relaxed, fluid distribution, generally supporting the pyramidal shape of cushioning elements 200. Second response state 620 represents a state in which a relatively strong or "rapid" force is being applied to cushioning elements 200. In second response state 620, a second set 670 of dilatant material elements is represented. Second set 670 reflects a rearrangement of the dilatant material relative to first set 660, where the distribution of the elements place them near the outer boundaries of the shape, and are rigidly supporting the pyramidal shape of cushioning elements 200. In one embodiment, the maximum or peak height can remain relatively unchanged between a first height 602 to a second height 604.

In contrast, third response state 630 represents a state in which a relatively weak or "slow" force is being applied to cushioning elements 200. In third response state 630, a third set 680 of dilatant material elements is represented. Third set 680 reflects the pliability of the dilatant material when a more gentle force (relative to second response state 620) is applied, such that the shape of the cushioning elements have been permitted to deform substantially. The tapered peak or apex of the pyramidal shape that was shown in first response state 610 has been compressed until the upper surface of an encapsulating material 650 has become substantially flattened. In one embodiment, the maximum or peak height can decrease from first height 602 to a third height 606. Thus, unlike second response state 620, the distribution of the elements remains substantially fluid and/or relaxed in third response state 630.

The responses described herein may be useful in various applications related to articles of apparel in some embodiments. In some embodiments, the responses can be utilized in articles of footwear. For example, in different embodiments, there can be structural components associated with an article of footwear that can offer various orthopedic benefits to a user. As noted earlier, an article of footwear can include provisions that can allow a user to receive feedback regarding certain aspects of his or her behavior during particular activities. In some embodiments, first cushioning system 250 as depicted in the figures above can interact with a foot and provide a user with sensory information that can be utilized by the user to selectively (i.e., intentionally) or automatically (i.e., subconsciously) make adjustments in the behavior of his or her foot during different activities. In one embodiment, for example, first cushioning system 250 can provide tactile feedback to a user that can inform the user whether the foot is undergoing pronation. In some cases, the feedback may be related to the degree or the extent of the pronation that occurs. However, in other cases, the feedback may be related to the rate of the pronation, as will be discussed below with respect to FIG. 8.

The term "pronation" as used in this disclosure is used to describe an abnormal lateral (inwards) rotation of the foot that can occur during the foot's (or footwear's) contact with the ground. A certain amount of pronation (which will be referred to herein as "normal pronation") is considered natural for a healthy gait. However, if the foot rotates beyond the normal or a healthy range of rotation, abnormal pronation (herein referred to as "pronation") is said to have occurred. Thus, pronation of the foot is not necessarily in itself injurious, but may over time leave an individual more susceptible to a number of injuries. In some cases, pronation can be understood to comprise a type of collapsing, flattening, and/or rolling-in of the foot. In one embodiment, the arch of the foot may collapse to a greater extent during (abnormal) pronation relative to normal pronation. However, it should be understood that in different cases, the timing associated with when and how quickly the foot rolls inward may also be important, as will be discussed below with respect to FIG. 8.

In different embodiments, the primary touch organ, skin, can be very sensitive to periodic applied pressures. Thus, some embodiments of the various cushioning systems as described herein can provide a wearable tactile feedback system that utilizes the "communication channel" of touch or sensation, to give real-time feedback to the wearer about their performance during various activities. The present embodiments can provide tactile feedback for a wearer to alert the wearer of a departure from a normal or healthy rate and/or range of pronation. The tactile feedback can help a user develop new learned behavior that supplants previous tendencies to over-pronate and assist in behavioral modification. A person's foot position and rate of pronation can thus be monitored and potentially while the user is engaged in normal activities. In one example, if a user over-pronates or pronates too quickly, the cushioning elements can stiffen, and the stiffening is felt by the wearer so he or she can choose to adjust their behavior.

Figure 7:
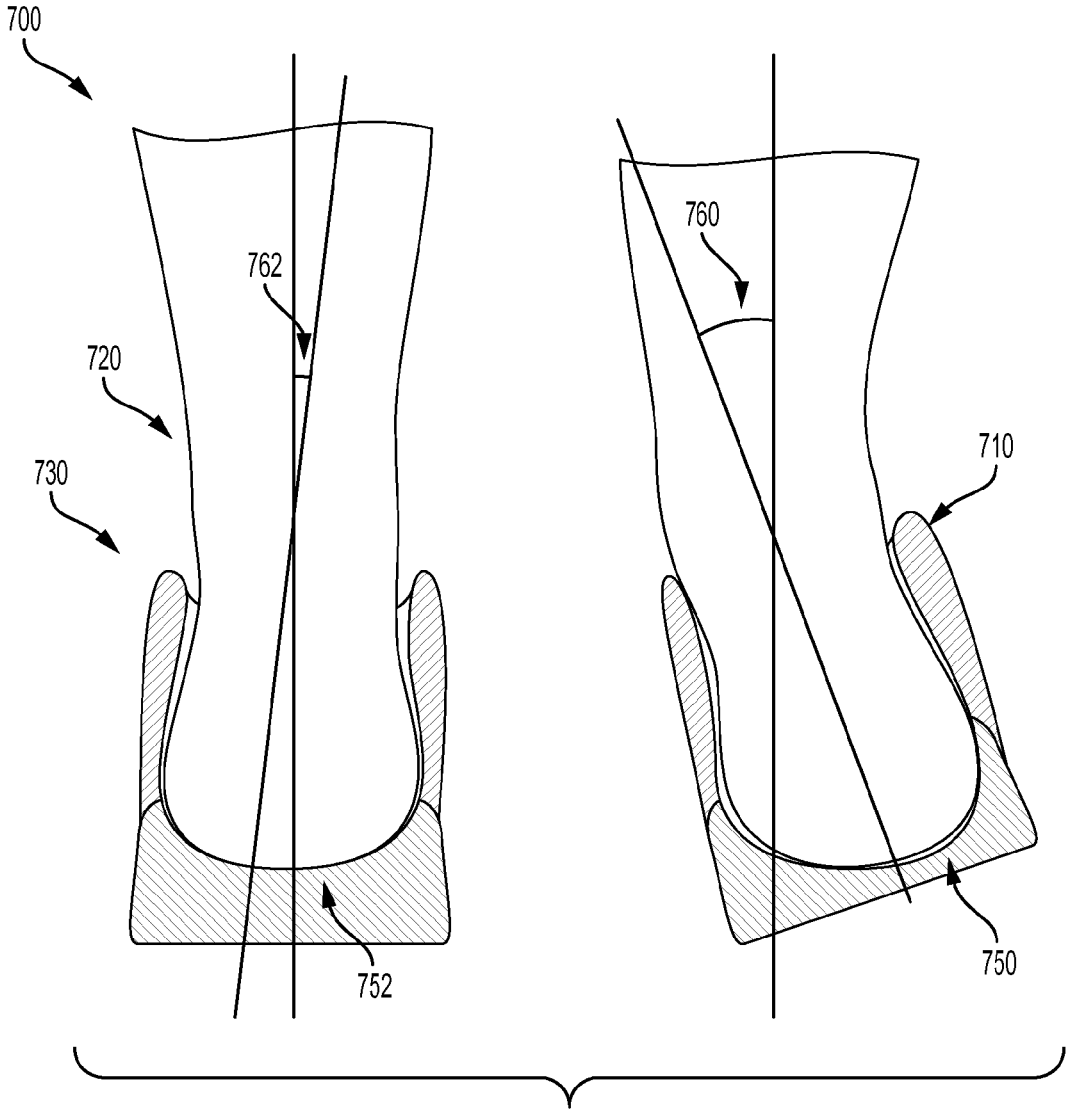
FIG. 7 is a rear view of an embodiment of a user experiencing pronation.

When a foot pronates during walking or running or other activities, the lower leg and foot can rotate inwardly (medially) beyond a healthy range. This in turn can increase stresses on the muscles, tendons, and ligaments of the foot and lower leg including the shin and the knee, as the limb rotates too far inward. In FIG. 7, a pair of feet 700 belonging to an individual who abnormally pronates is shown in cross section. Pair of feet 700 are illustrated wearing a pair of footwear 730. Right foot 710 is depicted rolling inward, while a corresponding left foot 720 is in what would be considered a normal (healthy) position.

In different embodiments, during a person's gait cycle, the outside part of a first heel 750 and corresponding second heel 752 make initial contact with the ground. For purposes of this disclosure, a gait cycle is the time period or sequence of events or movements during regular locomotion from the point at which one foot contacts the ground to the point when that same foot again contacts the ground. In FIG. 7, the pronating foot (here, right foot 710), is depicted as it "rolls" inward further than the generally accepted normal range of approximately 15 percent during pronation. This is illustrated by the contrast between a first range 760 associated with right foot 710 and a second range 762 associated with a left foot 720, where second range 762 should be understood to represent an accepted normal range. As a result, in some cases, at the end of the gait cycle, the front of right foot 710 will typically tend to push off the ground using mainly the big toe and second toe (not shown). It is generally understood that pronation can often be experienced during intense locomotion, principally during athletic activities where body weight on the heel is increased.

In some embodiments, one manner in which pronation may be measured is through the degree or range of rotation by a foot during an activity. However, in other embodiments, some effects of pronation may be due to other factors. In one embodiment, the rate of pronation, in contrast to the extent of pronation, may be correlated with the susceptibility of a user to various orthopedic effects. Thus, in some cases, an article of footwear that can provide information to a user regarding either their pronation range and/or pronation rate may be beneficial.

Figure 8:
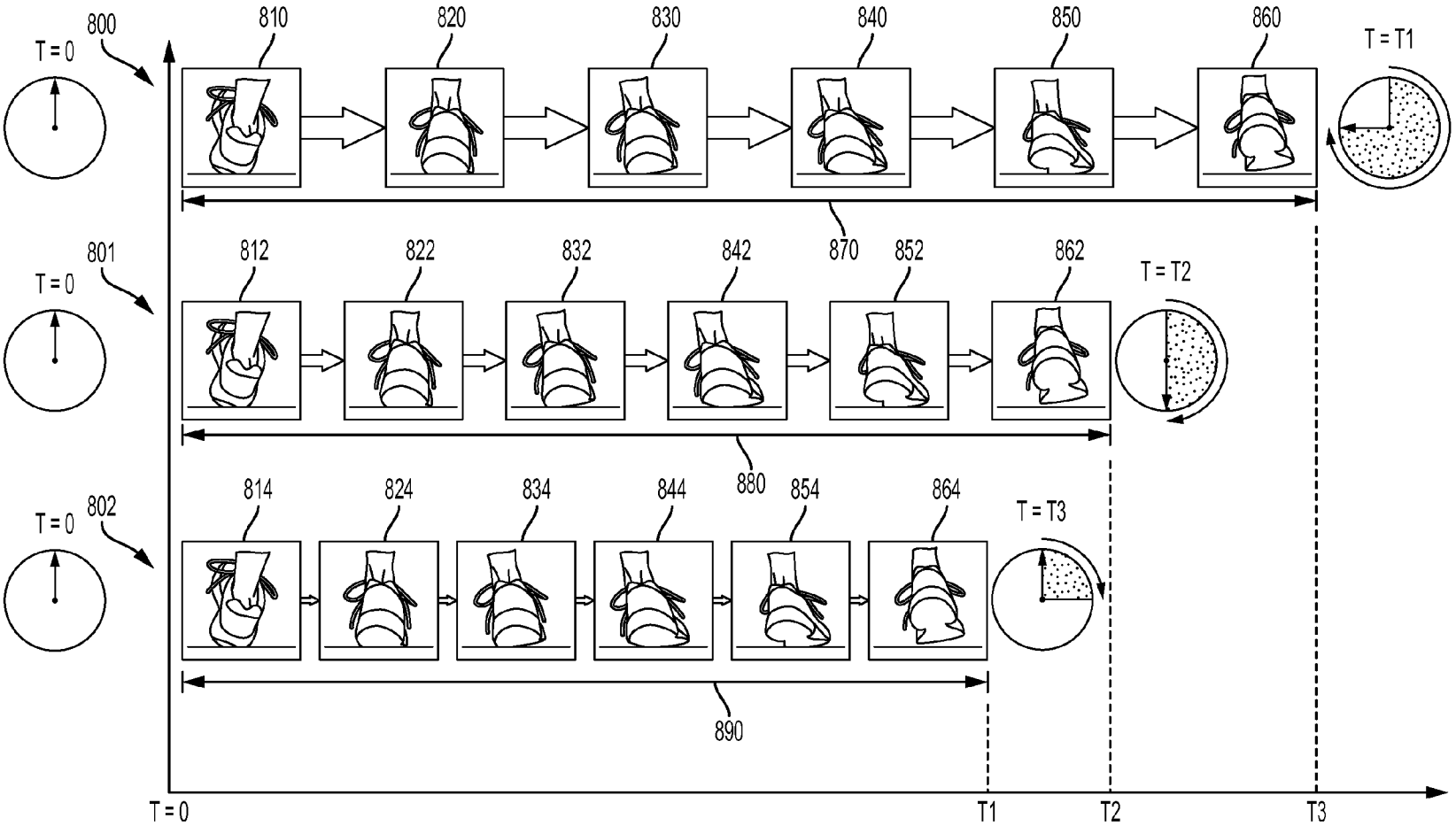
FIG. 8 is a schematic view of an embodiment of a user exhibiting three different rates of pronation.

To better illustrate the concepts discussed herein, FIG. 8 is a schematic graph that depicts an embodiment of three different rates of pronation. A first rate 800 of pronation is illustrated near the top of the graph of FIG. 8, a second or intermediate rate 801 of pronation is illustrated below first rate 800, and a third rate 802 of pronation is illustrated near the bottom of the graph of FIG. 8. In each rate, a sequence of six "snapshots" of a left foot are shown, where each snapshot represents a moment in time during a gait cycle of an individual who exhibits abnormal pronation in at least the left foot during an activity. The snapshots are the same in each of the figures.

Furthermore, arrows are included between one snapshot and the adjacent snapshot to schematically represent the passage of time. Larger arrows (as shown in first rate 800) are representative of a greater duration of time relative to the arrows that are smaller (see second rate 801 and third rate 802). Thus, first rate 800 is in part represented by the arrows included between each of the snapshots, second rate 801 is represented in part by the arrows included between each of the snapshots, and third rate 802 is represented in part by the arrows included between each of the snapshots. It can thus be understood that the sequence comprising each gait cycle is represented such that each cycle is completed over a different duration of time. In first rate 800, the gait cycle begins at T=0 (initial time point) and occurs over a first duration T1, represented also by a first span of time 870. In second rate 801, the gait cycle begins at T=0 (initial time point) and occurs over a second duration T2, represented also by a second span of time 880, and in third rate 802, the gait cycle begins at T=0 (initial time point) and occurs over a third duration T3, represented also by a third span of time 890. First duration T1 can be seen to be longer than second duration T2. Furthermore, second duration T2 is longer than third duration T3.

Referring to first rate 800, there is a first snapshot 810 depicting the heel strike of a foot, a second snapshot 820 depicting the foot coming downward more fully, and a third snapshot 830 depicting the foot beginning to roll inward (toward the medial side). These are followed by a fourth snapshot 840 depicting the rolling of the foot continuing further inward, a fifth snapshot 850 depicting the foot beginning to near the end of the gait cycle by raising the heel higher off the ground, and a sixth snapshot 860 depicting the uneven pushing off of the foot that can occur during the end of a gait cycle that includes pronation. Similarly, second rate 801 comprises the same sequence of snapshots, including a seventh snapshot 812, an eighth snapshot 822, a ninth snapshot 832, a tenth snapshot 842, an eleventh snapshot 852, and a twelfth snapshot 862. In addition, third rate 802 includes the same sequence as well, as depicted in a thirteenth snapshot 814, a fourteenth snapshot 824, a fifteenth snapshot 834, a sixteenth snapshot 844, a seventeenth snapshot 854, and an eighteenth snapshot 864.

Thus, for purposes of illustration, each set of the six images comprises the same steps of a pronating gait cycle. It should be understood that in other embodiments, a foot that exhibits pronation can rotate in a variety of ways, and the sequence may differ from the examples shown in FIG. 8. However, while each of the gait cycle sequences depict essentially the same gait cycle, it can be seen that the rate of pronation in which the cycle occurs is different for each rate. First rate 800 may be understood to be slower than second rate 801. In addition, second rate 801 may be understood to be slower than third rate 802. In other words, the gait cycle comprising first rate 800 takes a longer period of time to complete than the same gait cycle shown in second rate 801, and the gait cycle of second rate 801 takes a longer period of time to complete than the same gait cycle shown in third rate 802.

In some embodiments, a faster rate of pronation may increase the susceptibility of an individual to orthopedic complications. Thus, in some embodiments, it may be advantageous to provide an individual with feedback related to the rate at which the individual is pronating. In different embodiments, various structural components may be included in an article of footwear that can inform, guide, direct, or otherwise influence users to increase their awareness of their pronation rate and/or encourage them to manage their rate of pronation differently. This management may occur consciously (i.e., intentionally) as a result of the feedback in some embodiments. In other embodiments, the management of the pronation rate may occur subconsciously, such that the person's brain or nervous system responds to the tactile feedback automatically and seeks to compensate or adjust his or her behavior in response to that feedback.

For purposes of this disclosure, tactile feedback refers to feedback that is provided to an individual through the indirect or direct sensation of touch. Thus, any feedback that is given through sensations like changes in pressure (mechanoreception), temperature (thermoception), and pain (nociception) may be considered tactile. In some embodiments, the input to a person that can be registered from the sense of touch can be formed from several modalities including pressure, skin stretch, vibration, and temperature.

Figure 9:
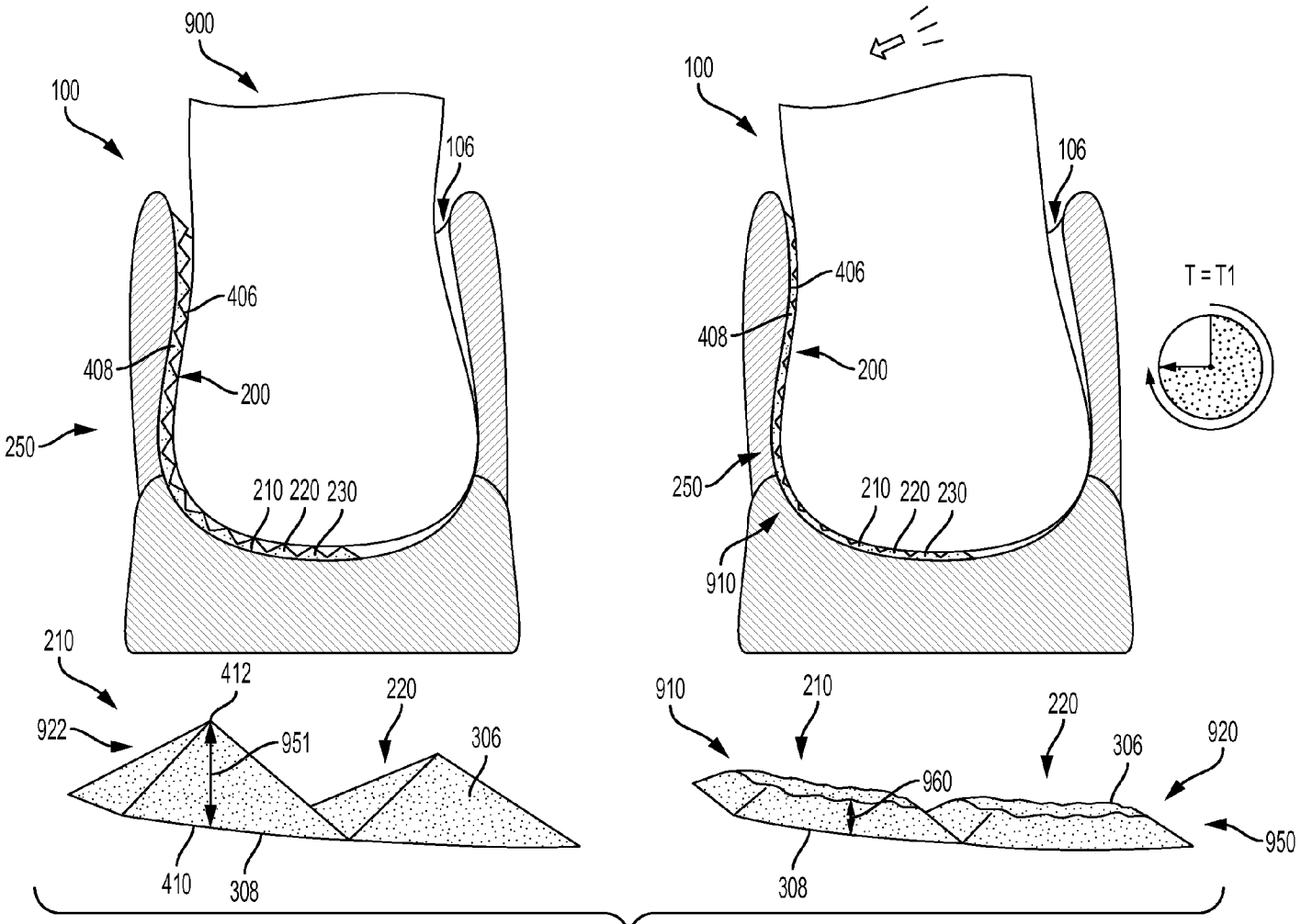
FIG. 9 is a cross-sectional view of two embodiments of an article of footwear with a cushioning system.
Figure 10:
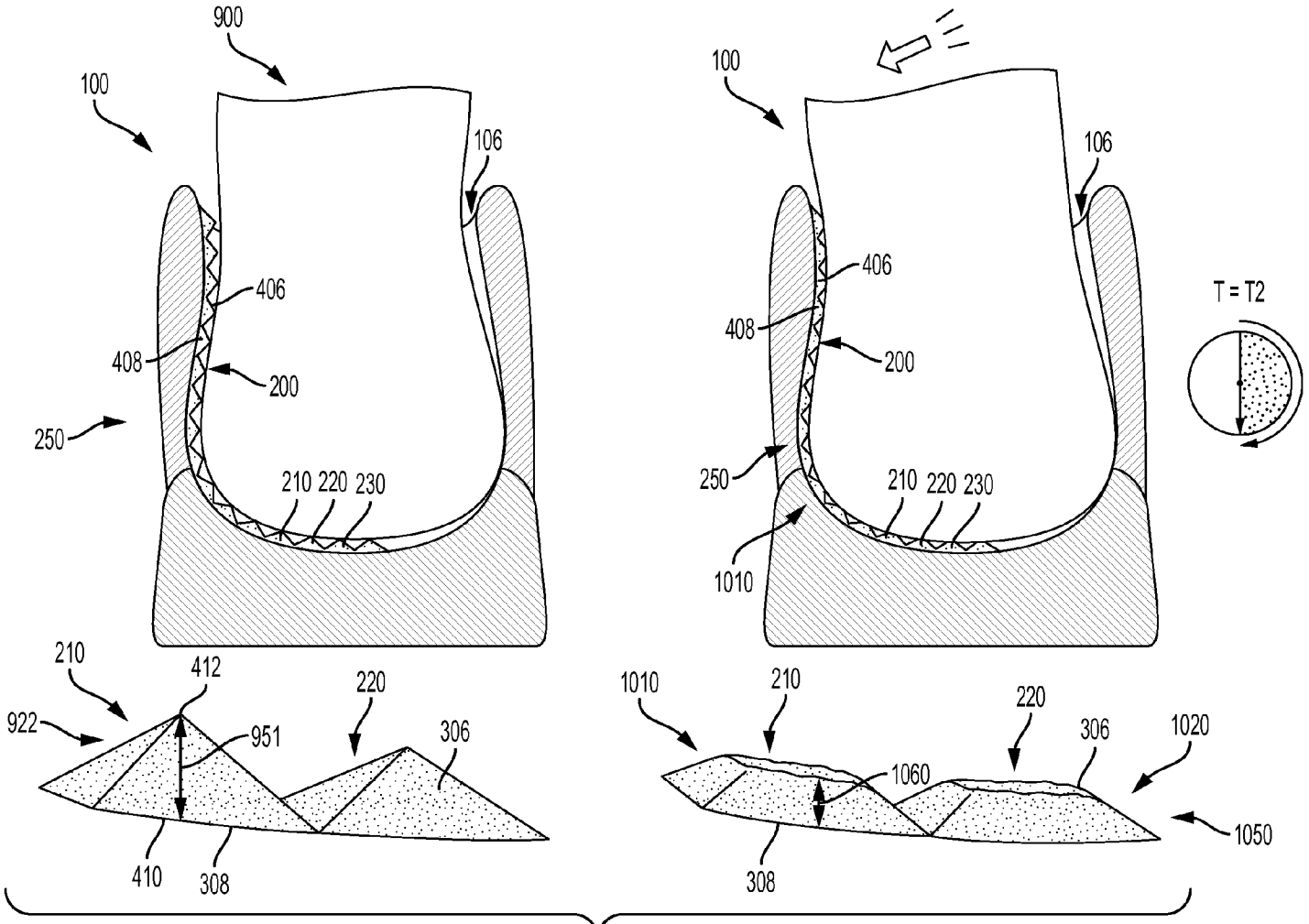
FIG. 10 is a cross-sectional view of two embodiments of an article of footwear with a cushioning system.
Figure 11:
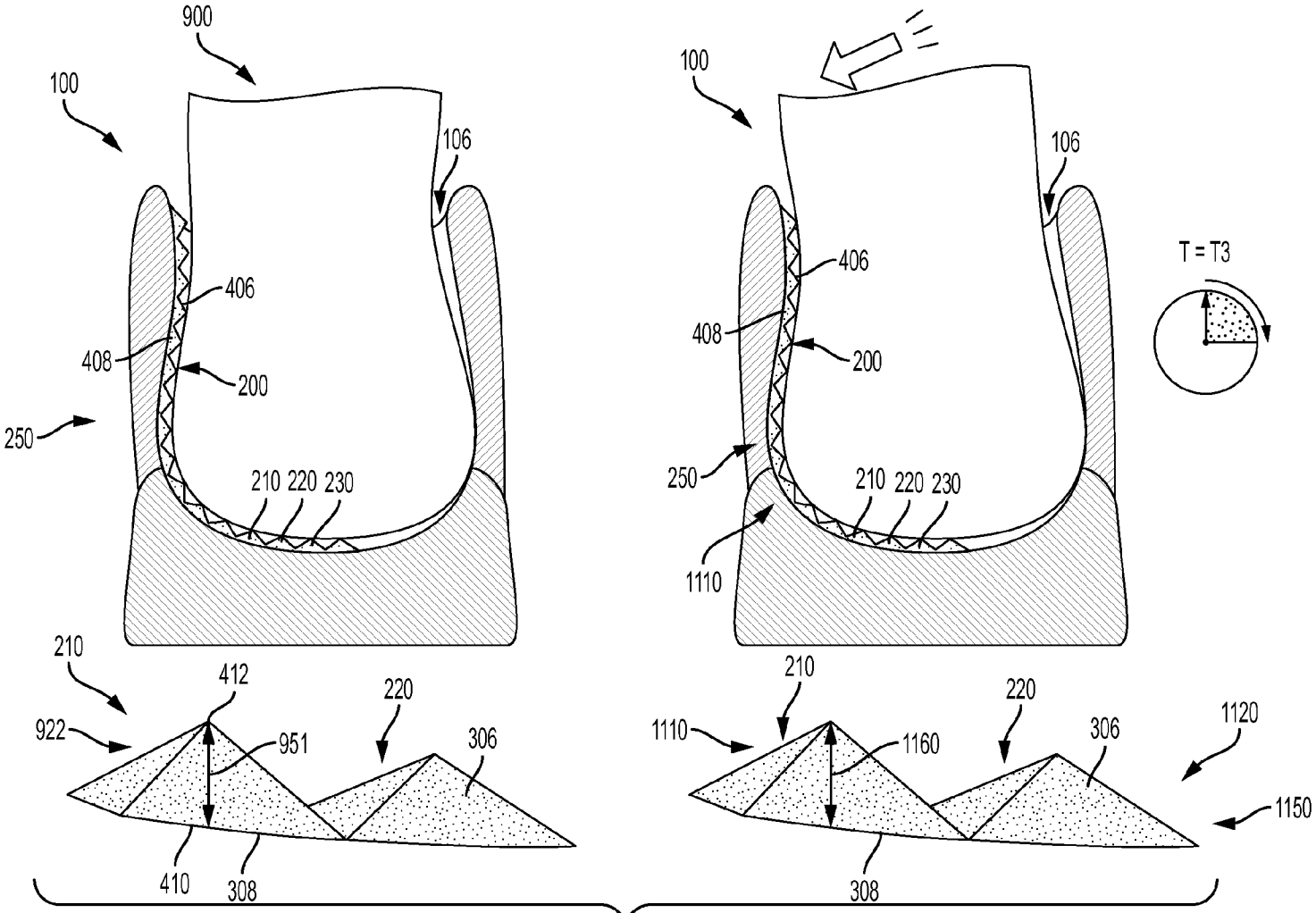
FIG. 11 is a cross-sectional view of two embodiments of an article of footwear with a cushioning system.

In different embodiments, a component or structure can be provided that can generally indicate to a user whether his or her rate of pronation is greater than or less than a particular reference level. As noted above, this information can be used to adjust the rate of pronation, if desired. Referring now to FIGS. 9-11, three possible embodiments of the response of a portion of first cushioning system 250 is shown. Each of FIGS. 9-11 includes a depiction of a cross section of an embodiment of first cushioning system 250 in a neutral state 900 as a reference for the convenience of the reader. In FIGS. 9-11, the cross sections depicting neutral state 900 illustrate the triangular shape of first element 210, second element 220, and third element 230, as well as other neighboring cushioning elements. In FIGS. 9-11, it can be seen that multiple elements of first cushioning system 250 are disposed in a substantially continuous manner, adjacent to and contacting one another, to comprise first surface 406 and second surface 408. As noted above in FIG. 3, first surface 406 and second surface 408 are substantially continuous, due to the contiguous, grid-like arrangement of the adjacent cushioning elements 200.

Referring to FIGS. 9-11, each depiction of neutral state 900 is shown above a second illustration 922 that provides a magnified view of first element 210 and second element 220 in the neutral state. In FIGS. 9-11, it can be seen that first element 210 and second element 220 in neutral state 900 each include a substantially triangular cross-sectional geometry, as discussed above with respect to FIGS. 3 and 4. Thus, first surface 406 in neutral state 900 includes sharp undulations and has repeated protruding tapering peaks (apexes) associated with each element. For purposes of reference, it can be seen that first element 210 has an initial thickness 951 in each neutral state 900 of FIGS. 9-11 associated with the maximum height of the element extending from first base 410 to first apex 412.

In FIG. 9, neutral state 900 of first cushioning system 250 in article 100 may be contrasted with an example of first cushioning system 250 as it responds to the first rate of pronation (as represented in the schematic graph of FIG. 8), identified here as a first response 910. Similarly, in FIG. 10, neutral state 900 of first cushioning system 250 in article 100 may be contrasted with an example of first cushioning system 250 as it responds to the second rate of pronation (as represented in the schematic graph of FIG. 8) identified here as a second response 1010. In addition, in FIG. 11, neutral state 900 of first cushioning system 250 in article 100 may be contrasted with an example of first cushioning system 250 as it responds to the third rate of pronation (as represented in the schematic graph of FIG. 8) here identified as a third response 1110.

To better illustrate each of these behaviors, magnified views are also included below each of the figures. In FIG. 9, a first magnified view 950 shows the dilatant fluid material comprising first element 210 and second element 220 of article 100 exhibiting first response 910 as a result of the application of a relatively low-level force associated with first rate 800 (see FIG. 8). First element 210 and second element 220 are substantially deformed in this response, and are associated with a first degree of deformation 920. In other words, the geometry of first element 210 and second element 220 has been altered such that each element no longer comprises a cross-sectional triangular shape. While first surface 406 retains an overall curvature that follows the curvature defining interior cavity 106, first surface 406 is also substantially flatter and smoother relative to first surface 406 in neutral state 900. It should be understood that, in some embodiments, some bumps or irregularities may remain along first surface 406 during first response 910. In addition, in some embodiments, some portions of first surface 406 may be more flattened than other portions, as the force or load that is applied may not be evenly distributed. Furthermore, it can be seen that first element 210 now has a first thickness 960 that is different from initial thickness 951. In FIG. 9, first thickness 960 is substantially decreased, and is smaller relative to initial thickness 951.

In a second magnified view 1050 provided in FIG. 10, the dilatant fluid material comprising first element 210 and second element 220 of article 100 is shown exhibiting second response 1010 as a result of the application of the "intermediate" force associated with second rate 801 (see FIG. 8). First element 210 and second element 220 of article 100 are partially deformed, and are associated with a second degree of deformation 1020 that is less than first degree of deformation 920 of FIG. 9. In other words, the geometry of first element 210 and second element 220 has been altered such that each element no longer comprises a cross-sectional triangular shape. However, first surface 406 of second response 1010 retains a gentle undulating pattern, where bumps or small "hills" that correspond to each element are discernible. It can be seen that first surface 406 in second response 1010 is flatter relative to neutral state 900, but it is not flattened to the extent of first response 910 of FIG. 9. Thus, in some embodiments, the cross-sectional profile of first cushioning system 250 in second response 1010 may resemble a series of rounded bumps, or include a geometry similar to a pattern of repeated semicircles. It should be understood that, in some embodiments, some portions of first surface 406 may be more flattened than other portions, as the force or load that is applied may not be evenly distributed. Furthermore, it can be seen that first element 210 now has a second thickness 1060 that is different from both initial thickness 951 and first thickness 960 (see FIG. 9). In FIG. 10, second thickness 1060 is shown as substantially decreased relative to initial thickness 951. However, second thickness 1060 of FIG. 10 can be greater than first thickness 960 of FIG. 9, as shown.

Referring now to FIG. 11, a third magnified view 1150 depicts the dilatant fluid material comprising first element 210 and second element 220 of article 100 exhibiting third response 1110 as a result of the relatively larger force associated with third rate 802 (see FIG. 8). First element 210 and second element 220 in FIG. 11 are minimally deformed, and are associated with a third degree of deformation 1120 that is less than both first degree of deformation 920 of FIG. 9 and second degree of deformation 1020 of FIG. 10. In other words, the geometry of first element 210 and second element 220 may be slightly altered, but each element substantially retains the cross-sectional triangular shape of neutral state 900. It should be understood that, in some embodiments, some portions of first surface 406 in third response 1110 may be more flattened than other portions, as the force or load that is applied may not be evenly distributed. Furthermore, it can be seen that first element 210 now has a third thickness 1160 that is different from both first thickness 960 and second thickness 1060. In FIG. 11, third thickness 1160 is shown as substantially similar to initial thickness 951. However, third thickness 1160 of FIG. 11 may be greater than both second thickness 1060 of FIG. 10 and first thickness of FIG. 9, as shown. In other words, a more rapid rate of pronation may elicit less deformation than a slower rate of pronation.

Thus, in some embodiments, third rate 802 of FIG. 8, comprising a higher magnitude of force than either first rate 800 or second rate 801, can result in less compression and deformation of a cushioning element. Similarly, a rate of pronation that is slower (as shown with respect to first rate 800 in FIG. 8) may elicit a more pliable response from the material of first cushioning system 250 and lead to greater deformation and a larger decrease in thickness in some embodiments.

The various illustrations of deformation of the material of first cushioning system 250 shown above may provide different sensory experiences for a user. As a cushioning element (e.g., first element 210) is compressed during a particular rate of pronation, the cushioning element can respond by becoming increasingly rigid or stiff or by becoming increasingly yielding. In other words, in some embodiments, first cushioning system 250 can contact or press against a foot (or a material such as a sock worn by the foot) and alter the user's tactile sensation. In some cases, such as when the rate of pronation is relatively higher (see FIG. 11), the cushioning system can produce a more noticeable sensation to a user. In one embodiment, the sensation can be more noticeable when the area of contact of the cushioning elements with the user are smaller, and/or protrude to a greater degree against the user's foot, as shown above with respect to the triangular shapes of the cushioning elements in FIGS. 1-11. In some embodiments, the peaks associated with the cushioning elements of first cushioning system 250 can act as specialized contact points that provide a particular pressure against a user's foot. The sensation of such peaks against a foot can prompt a user to modify their behavior in different embodiments.

In some cases, the user can learn what rate causes the cushioning elements to yield and provide a more gentle response, and what rates cause the cushioning elements to become rigid and provide a stiffer response. In some embodiments, this tactile information may allow a user to learn to maintain a desired rate of pronation over time. Furthermore, the article may be removed or utilized as required. The cushioning system may thus provide a gentle alert to the wearer to assume a correct, healthier, or improved pronation rate and/or range throughout various movements and positions. The feel of the different cushioning elements against a foot can also continuously serve to remind the wearer to maintain the healthier gait cycle.

Figure 12:
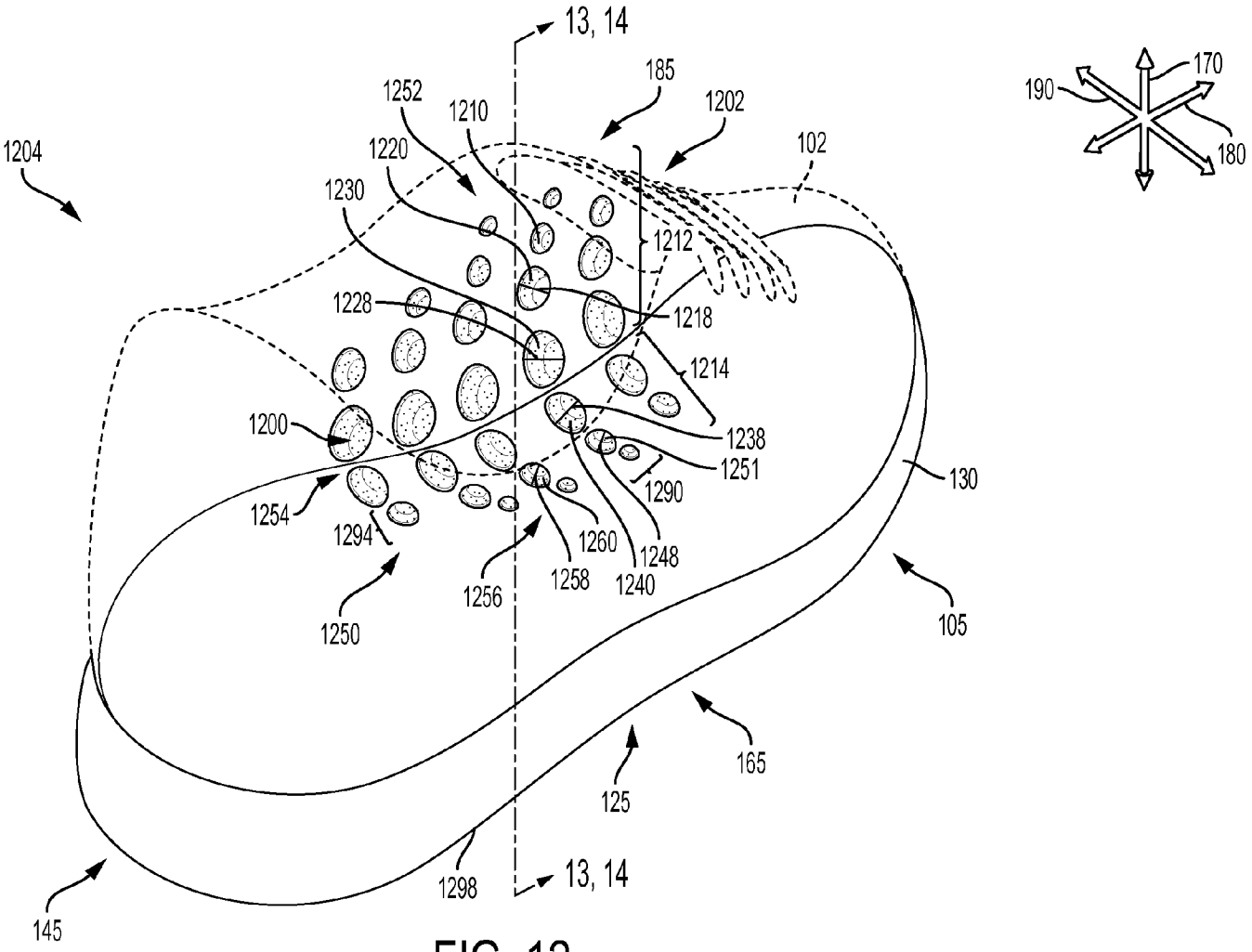
FIG. 12 is an isometric view of an embodiment of an article of footwear with a cushioning system.
Figure 13:
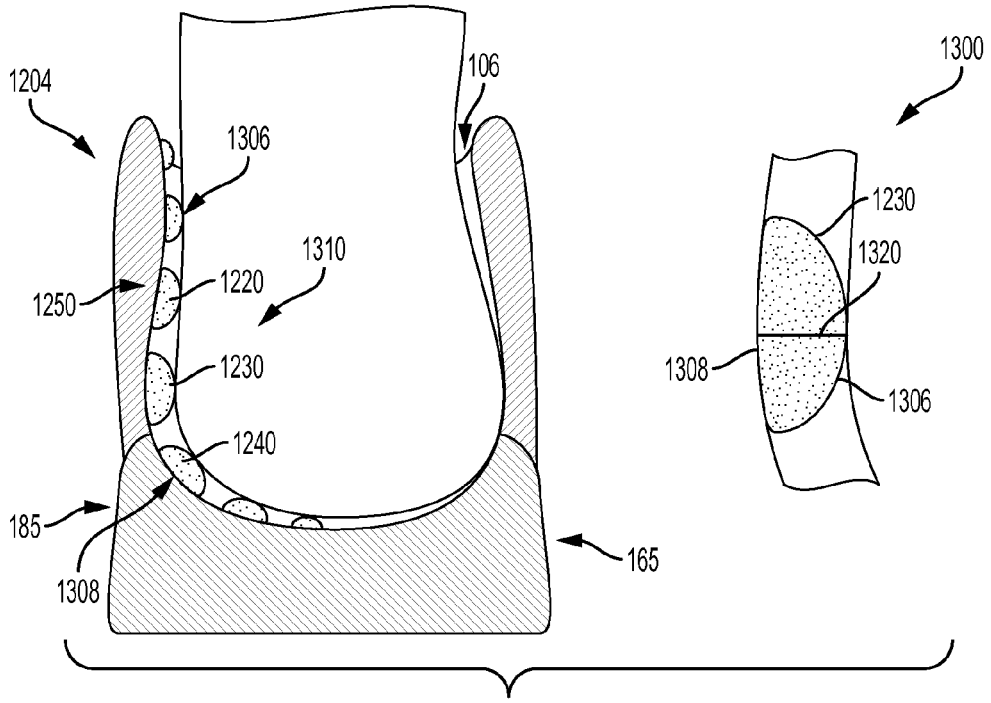
FIG. 13 is a cross-sectional view of an embodiment of an article of footwear with a cushioning system.
Figure 14:
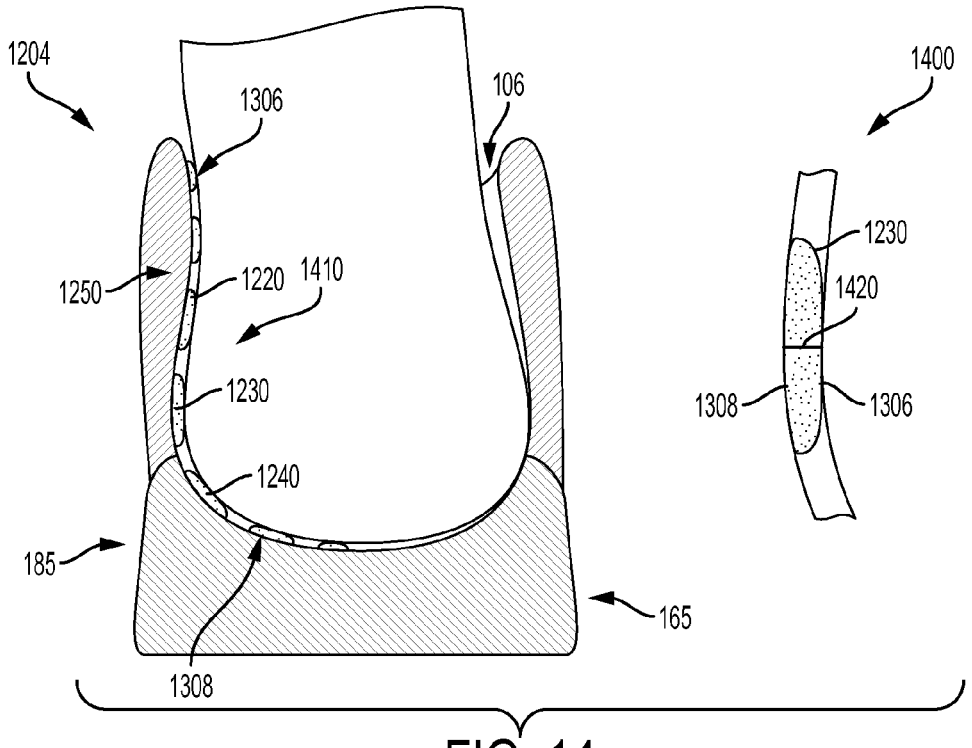
FIG. 14 is a cross-sectional view of an embodiment of an article of footwear with a cushioning system undergoing deformation.

Another embodiment of the cushioning systems is depicted with a second article of footwear 1204 in FIGS. 12-14. Second article of footwear 1204 includes a second dynamic cushioning system ("second cushioning system") 1250 that comprises a plurality of cushioning elements 1200. It should be understood that the features, properties, and/or configurations of second cushioning system 1250 and cushioning elements 1200 as shown in FIGS. 12-14 may incorporate any of the concepts disclosed above with respect to first cushioning system 250 or cushioning elements 200. FIGS. 12-13 depict second cushioning system 1250 in a neutral state, where the neutral state refers to a state in which the cushioning elements are not experiencing the application of an external force as discussed above.

In some embodiments, two or more cushioning elements 1200 may be arranged adjacent to and/or contiguous with one another. For example, as shown in FIG. 12, cushioning elements 1200 are arranged near one another in a series of rows. In some embodiments, cushioning elements 1200 may be configured to form an array of cushioning elements that are spaced apart from one another and comprise second cushioning system 1250. It should be understood that, in other embodiments, cushioning elements 1200 may be arranged further apart from or nearer to one another than depicted in FIG. 12. Cushioning elements 1200 of second cushioning system 1250 may be contrasted to first cushioning system 250 of FIG. 2 above, in which cushioning elements 200 are substantially contiguous with little or no spacing between cushioning elements 200.

Furthermore, in different embodiments, second cushioning system 1250 may be disposed along or through portions of upper 102. In FIG. 12, cushioning elements 1200 extend along medial side 185 of upper 102. Cushioning elements 1200 can also extend along or through portions of sole structure 130 in some embodiments. Thus, for purposes of reference, second cushioning system 1250 may be understood to include a first portion 1212 of cushioning elements that are associated with upper 102 and a second portion 1214 of cushioning elements that are associated with or disposed adjacent to sole structure 130. In some embodiments, first portion 1212 and second portion 1214 may be separate and distinct. However, in other embodiments, first portion 1212 and second portion 1214 may be continuous in some portions, such that one or more elements extends across and is adjacent to or attached to both sole structure 130 and upper 102. In addition, for purposes of reference, first cushioning system 250 has a first end 1252 near a lacing region 1202, an intermediate portion 1254 extending generally along medial side 185 of upper 102 near midfoot portion 125, and a second end 1256 associated with the end of second cushioning system 1250 disposed nearest a bottom 1298 of sole structure 130.

FIG. 12 depicts an embodiment of a first cushioning element ("first element") 1210, a second cushioning element ("second element") 1220, a third cushioning element ("third element") 1230, a fourth cushioning element ("fourth element") 1240, a fifth cushioning element ("fifth element") 1251, and a sixth cushioning element ("sixth element") 1260. First element 1210, second element 1220, third element 1230, fourth element 1240, and fifth element 1251 comprise a first column 1290. Additionally, fifth element 1251 and sixth element 1260 comprise a first row 1294. In other words, first element 1210, second element 1220, third element 1230, fourth element 1240, and fifth element 1251 are arranged to extend in a slightly curved manner in a direction generally aligned with vertical axis 170, along medial side 185 of upper 102, where first element 1210 is disposed closer to lacing region 1202 than any of second element 1220, third element 1230, fourth element 1240, and fifth element 1251. Fifth element 1251 and sixth element 1260 are arranged in a direction generally aligned with lateral axis 190 along medial side 185 of upper 102, where fifth element 1251 is disposed closer to forefoot portion 105 than sixth element 1260.

As described earlier, in different embodiments, cushioning elements 1200 may comprise any three-dimensional shape or geometry, including regular or irregular shapes. For example, cushioning elements 1200 may be substantially flat or narrow, and/or relatively thick or wide. The geometry and dimensions of a cushioning element can be configured for the application or exercise in which it will be used. For illustrative purposes, in FIGS. 12-14, cushioning elements 1200 have a generally spherical, ellipsoid, or a substantially round three-dimensional shape, and/or have a cross-sectional shape that is rounded, or generally semicircular or semielliptical.

In some other embodiments, cushioning elements 1200 may comprise a square, triangular, oblong, elliptical, hexagonal, pentagonal, or star shape, or any other regular or irregular geometry. Thus, in some cases, the cross-sectional shape of cushioning elements 1200 may similarly range from square, round, triangular, pyramidal, oblong, elliptical, hexagonal, pentagonal, or star shape, or a partial regular or irregular shape. It can be seen that each of first element 1210, second element 1220, third element 1230, fourth element 1240, fifth element 1251, and sixth element 1260 include a substantially round geometry. However, it should be understood that in other embodiments, two or more cushioning elements 1200 may each comprise a geometry or shape that differs from each other.

Furthermore, in different embodiments, the sizes of two or more cushioning elements 1200 may vary. For example, in FIG. 12, second element 1220 has a first diameter 1218, third element 1230 has a second diameter 1228, fourth element 1240 has a third diameter 1238, fifth element 1251 has a fourth diameter 1248, and sixth element 1260 has a fifth diameter 1258. In some embodiments, first diameter 1218, second diameter 1228, third diameter 1238, fourth diameter 1248, and fifth diameter 1258 may be substantially similar. However, in other embodiments, two or more of first diameter 1218, second diameter 1228, third diameter 1238, fourth diameter 1248, and/or fifth diameter 1258 may differ such that the diameter of one cushioning element is greater than the diameter of another cushioning element. Similarly, in some embodiments, two or more of first diameter 1218, second diameter 1228, third diameter 1238, fourth diameter 1248, and/or fifth diameter 1258 may be substantially similar. As shown in FIG. 12, first diameter 1218 is less than second diameter 1228; second diameter 1228 is less than third diameter 1238; and third diameter 1238 is greater than fourth diameter 1248. Furthermore, third diameter 1238 is substantially similar to first diameter 1218 in the embodiment of FIG. 12. In addition, in one embodiment, fifth diameter 1258 may be substantially similar to fourth diameter 1248.

Thus, the dimensions of each cushioning element can vary throughout second article of footwear 1204. It should be understood that the various dimensions can differ from that shown here and are for illustrative purposes only. Thus, cushioning elements 1200 can include any diameter from nearly zero to nearly an entire length, width, and/or height of upper 102 or sole structure 130.

In another embodiment, the size of individual cushioning elements may be larger (or smaller) in some regions relative to other regions. In some embodiments, cushioning elements 1200 arranged nearer first end 1252 are smaller relative to cushioning elements 1200 nearer to intermediate portion 1254. In other words, the diameter of some elements of second cushioning system 1250 near first end 1252 may be smaller than the diameter of other elements 1200 nearer to intermediate portion 1254. In some cases, both the size and number of cushioning elements 1200 may be adjusted to increase the area of first cushioning system 250 that includes cushioning elements 1200 in a particular region. Similarly, in some embodiments, the diameter of some cushioning elements 1200 nearer to second end 1256 can be smaller than the diameter of other cushioning elements 1200 nearer to intermediate portion 1254. In some cases, the diameter of elements near first end 1252 may be similar to the diameter of elements near second end 1256. However, in another embodiment, elements near first end 1252 may be smaller than elements near second end 1256 (as shown in FIG. 12). In other embodiments, elements near first end 1252 may be larger than elements near second end 1256. In another embodiment, the diameters of each of cushioning elements 1200 may be uniform throughout second article of footwear 1204, or may be sized in a random distribution.

In addition, in some embodiments, the frequency of individual cushioning elements 1200 comprising second cushioning system 1250 can vary through different portions of second article of footwear 1204. In some embodiments, there may be a fewer or a greater number of cushioning elements 1200 in some regions relative to other regions of an article.

Referring now to FIG. 13, a cross section of an embodiment of second cushioning system 1250 is shown as it responds to the application of a force corresponding to third rate 802 of pronation (see FIG. 8). In FIG. 13, the cross section reveals one example of the rounded or bulged shapes of second element 1220, third element 1230, and fourth element 1240, as well as other neighboring cushioning elements. In some embodiments, second cushioning system 1250 can include a first side 1306 and a second side 1308. The texture of each side surface may vary in different embodiments. In some embodiments, first side 1306 and/or second side 1308 may be irregular, bumpy, or otherwise uneven. In other embodiments, first side 1306 and/or second side 1308 may be substantially smooth. Furthermore, the cross-sectional profile of each side surface may be different. For example, in FIG. 13, first side 1306 includes a series of curved, bulging areas, while second side 1308 is formed by a series of more smooth base segments, generally following the overall curvature of upper 102 and sole structure 130. In some cases, this is due to the shape of each cushioning element. In addition, in some embodiments, the profile associated with a side surface may be adjustable or deformed during the use of the article, as will be discussed further below.

Second cushioning system 1250 of FIG. 13 reflects minimal compression of cushioning elements 1200, and is associated with a fourth degree of deformation 1310. In other words, the geometry of one or more of the cushioning elements may be slightly altered, but each element substantially retains the cross-sectional semicircular shape of the neutral state depicted in FIG. 12. It should be understood that, in some embodiments, some portions of first side 1306 may be more flattened than other portions, as the force or load that is applied may not be evenly distributed. In a fourth magnified view 1300, third element 1230 is shown to have a fourth (maximum) thickness 1320 that may be substantially similar or only slightly different from the maximum thickness of third element 1230 in the neutral state of FIG. 12.

FIG. 14 represents an embodiment of second article of footwear 1204 as it responds to the application of a force corresponding to first rate 800 of pronation (see FIG. 8). In FIG. 14, it can be seen that several of the cushioning elements of second article of footwear 1204 are substantially deformed, and are associated with a fifth degree of deformation 1410. In other words, as shown in a fifth magnified view 1400, the geometry of third element 1230 has been altered such that the element no longer comprises a cross-sectional semicircular shape. While first side 1306 retains a slight bulged curvature, first side 1306 is also substantially flattened and smooth relative to the state of second cushioning system 1250 depicted in FIGS. 12 and 13. Furthermore, it can be seen that third element 1230 now has a fifth thickness 1420 that is different from fourth thickness 1320. In FIGS. 13 and 14, fifth thickness 1420 is substantially decreased relative to fourth thickness 1320. It should be understood that, in some embodiments, some bumps or irregularities may remain along first side 1306 while a force is applied. In addition, in some embodiments, some portions of first side 1306 may be more flattened than other portions, as the force or load that is applied may not be evenly distributed.

Thus, similar to the embodiments depicted earlier, a more rapid rate of pronation may elicit less deformation than a slower rate of pronation. Third rate 802 of FIG. 8, comprising a higher magnitude of force than first rate 800, can result in less compression and deformation of a cushioning element, as shown in FIG. 13. Similarly, a rate of pronation that is slower (as shown with respect to first rate 800 in FIG. 8) may elicit a more pliable response from the material of second cushioning system 1250 and lead to greater deformation and a larger decrease in thickness in some embodiments, as shown in FIG. 14.

The various illustrations of deformation of the material of second cushioning system 1250 shown can provide different sensory experiences for a user in different embodiments. As a cushioning element (e.g., first element 1210) is compressed during a particular rate of pronation, the cushioning element can respond by becoming increasingly rigid or stiff or by becoming increasingly yielding. In other words, in some embodiments, second cushioning system 1250 can contact or press against a foot (or a material such as a sock worn by the foot) and alter the user's tactile sensation. In some cases, such as when the rate of pronation is relatively higher (see FIG. 13), the cushioning system can produce a more noticeable sensation to a user. In one embodiment, the sensation can be more noticeable when the area of contact of the cushioning elements with the user are smaller, and/or resist the pressures of the user's foot, as shown above with respect to the round shapes of the cushioning elements in FIGS. 12-14. In some embodiments, the curvature associated with the cushioning elements of second cushioning system 1250 can act as specialized contact points that provide a particular pressure against a user's foot. The sensation of the rounded surface against a foot can prompt a user to modify their behavior in different embodiments, while the deformed, or flatter condition, can inform the user that the rate of pronation is in a desired range.

In some cases, the user can learn what rate causes the cushioning elements to yield and provide a more gentle response, and what rates cause the cushioning elements to become rigid and provide a stiffer response. In some embodiments, this tactile information may allow a user to learn to maintain a desired rate of pronation over time. Furthermore, the article may be removed or utilized as required. Second cushioning 1250 system may thus provide a gentle alert to the wearer to assume a correct, healthier, or improved pronation rate and/or range throughout various movements and positions. The feel of the different cushioning elements against a foot can also continuously serve to remind the wearer to maintain the healthier gait cycle.

Figure 15:
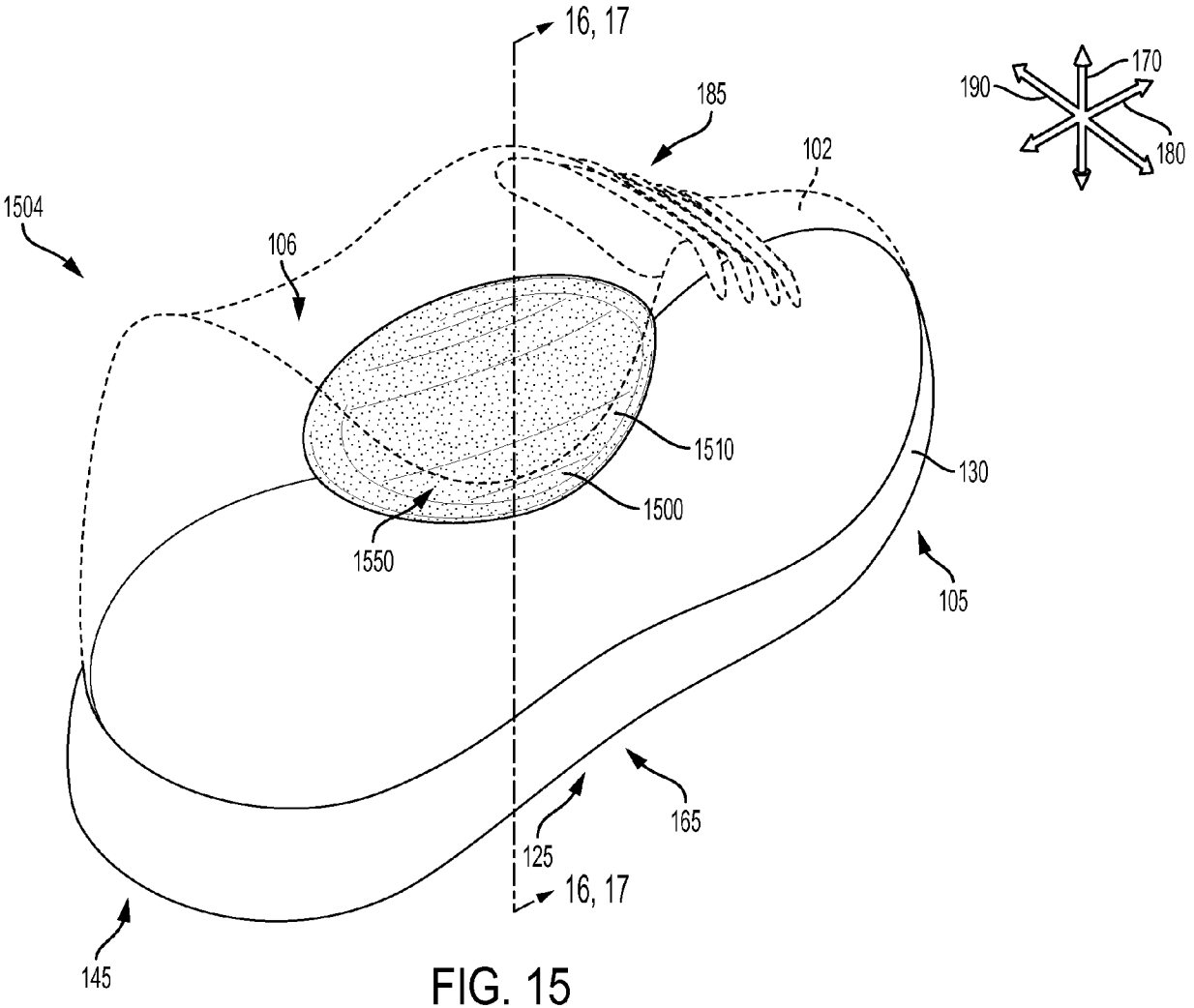
FIG. 15 is an isometric view of an embodiment of an article of footwear with a cushioning system.
Figure 17:
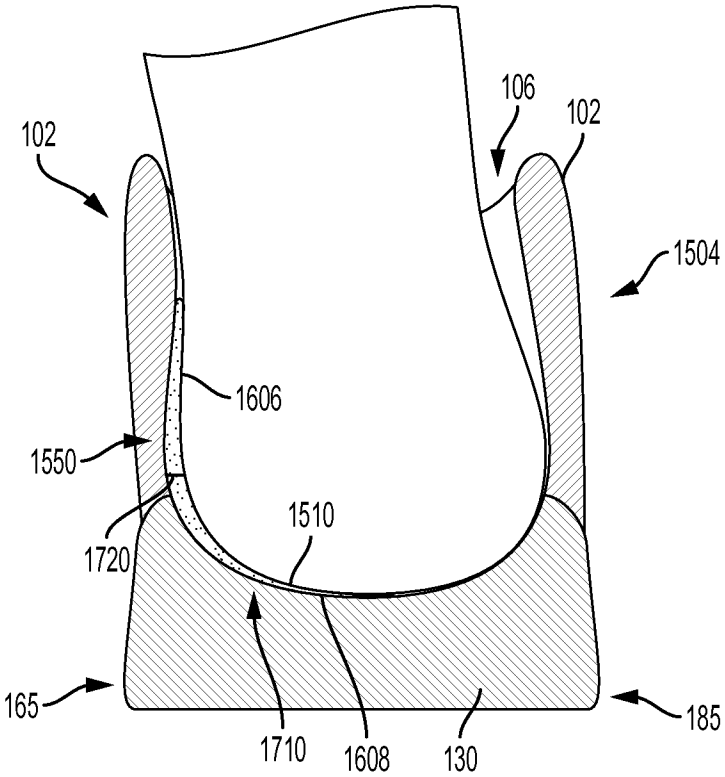
FIG. 17 is a cross-sectional view of an embodiment of an article of footwear with a cushioning system undergoing deformation.
Figure 16:
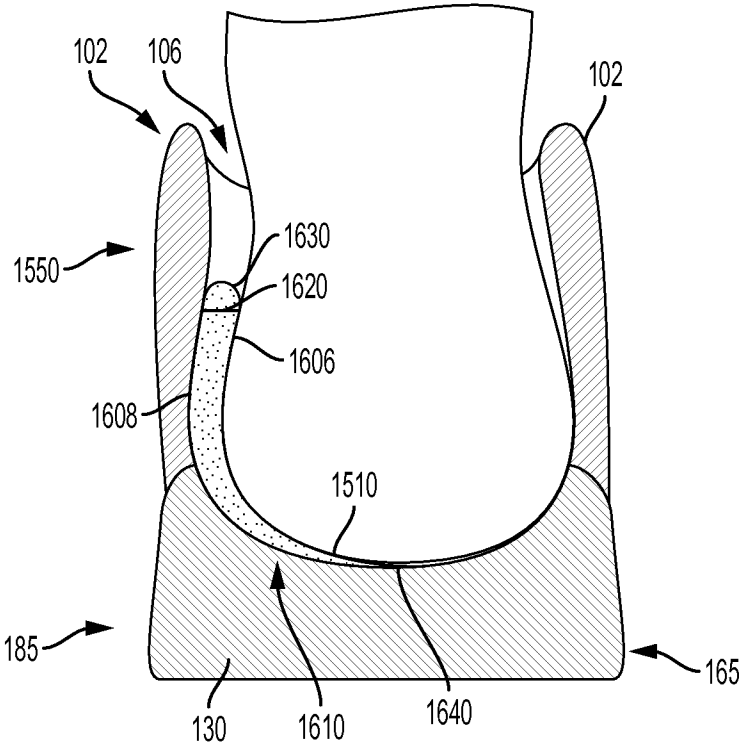
FIG. 16 is a cross-sectional view of an embodiment of an article of footwear with a cushioning system.

Another possible embodiment is illustrated with a third article of footwear 1504, shown in FIGS. 15-17 in a neutral state. Third article of footwear 1504 includes a third dynamic cushioning system ("third cushioning system") 1550 that can comprise at least one cushioning elements 1500. It should be understood that the features, properties, and/or configurations of third cushioning system 1550 and cushioning elements 1500 as shown in FIGS. 15-17 may incorporate any concepts disclosed above with respect to FIGS. 1-14.

FIG. 15 depicts an embodiment of a first cushioning element ("first element") 1510. It can be seen that first element 1510 is significantly larger in size than cushioning elements 1200 or cushioning elements 200. For example, the area of first element 1510 and the volume comprising first element 1510 may be understood to be larger than that of either first element 210 or first element 1210.

Thus, third cushioning system 1550 may be contrasted to first cushioning system 250 of FIG. 2 above, in which multiple cushioning elements 200 are joined along their edges to form a substantially continuous cushioning region. Third cushioning system 1550 also covers a large area, but through the inclusion of a single, larger cushioning element. Third cushioning system 1550 may also be contrasted to second cushioning system 1250 of FIG. 12, in which multiple cushioning elements 1200 are disposed throughout medial side 185 of the article of footwear to provide a cushioning region with spaced apart elements.

As described earlier, in different embodiments, a cushioning element may comprise any three-dimensional shape or geometry, including regular or irregular shapes. For example, first element 1510 may be substantially flat or narrow, and/or relatively thick or wide. The geometry and dimensions of first element 1510 can be configured for the application or exercise in which it will be used. For illustrative purposes, in FIG. 15, first element 1510 has a generally ellipsoid three-dimensional shape. As will be shown in FIGS. 16 and 17, first element 1510 can also include a substantially teardrop cross-sectional shape in some embodiments.

In other embodiments, first element 1510 may comprise a square, triangular, oblong, elliptical, hexagonal, pentagonal, or star shape, or any other regular or irregular geometry. Thus, in some cases, the cross-sectional shape of first element 1510 may similarly range from square, round, triangular, pyramidal, oblong, elliptical, hexagonal, pentagonal, or star shape, or a partial regular or irregular shape.

Furthermore, in different embodiments, the size of first element 1510 can vary. In other words, the dimension of first element 1510 can vary throughout third article of footwear 1504. It should be understood that the dimensions of first element 1510 can differ from that shown here and are for illustrative purposes only. Thus, first element 1510 can include any diameter from nearly zero to nearly an entire length, width, and/or height of upper 102 or sole structure 160.

Referring now to FIG. 16, a cross section of an embodiment of third cushioning system 1550 is shown as it responds to the application of a force corresponding to third rate 802 of pronation (see FIG. 8). In FIG. 16, the cross section reveals one example of the arrangement and geometry of first element 1510.

In some embodiments, first element 1510 may be disposed along or through portions of upper 102. In FIG. 16, first element 1510 extends along at least a portion of medial side 185 of upper 102. First element 1510 can also extend along or through portions of sole structure 130 in some embodiments. For example, in FIG. 16, first element 1510 extends across a substantial majority of the entire width of sole structure 130.

In some embodiments, third cushioning system 1550 can include a first surface side ("first side") 1606 and a second surface side ("second side") 1608. The texture of each side may vary in different embodiments. In some embodiments, first side 1606 and/or second side 1608 may be irregular, bumpy, or otherwise uneven. In other embodiments, first side 1606 and/or second side 1608 may be substantially smooth. In FIG. 16, it can be seen that both first side 1606 and second side 1608 are substantially smooth, while retaining a curvature that generally corresponds to the shape of interior cavity 106.

Furthermore, the cross-sectional profile or geometry associated with each side may be different. For example, in FIG. 16, first side 1606 includes a bulged portion at a first end 1630 that extends toward a tapered second end 1640. In other words, it can be seen that the cross-sectional shape of first element 1510 includes a rounded end (first end 1630) associated with medial side 185 of upper 102. First element 1510 then extends in a continuous manner through sole structure 130 toward lateral side 165 and gradually tapers to a narrow, relatively pointed end (second end 1640), forming a substantially teardrop-like shape.

In addition, as noted earlier, in some embodiments, the profile associated with a surface may be adjustable or deformed during the use of the article, as will be discussed further below. Third cushioning system 1550 of FIG. 16 reflects a minimal compression of first element 1510, and is associated with a sixth degree of deformation 1610. In other words, the geometry of first element 1510 may be slightly altered, but each element substantially retains the cross-sectional teardrop-like shape of the neutral state depicted in FIG. 15. It should be understood that, in some embodiments, some portions of first side 1606 may be more flattened than other portions, as the force or load that is applied may not be evenly distributed. In some embodiments, first element 1510 has a sixth (maximum) thickness 1620 that may be slightly different from the maximum thickness (not shown) of first element 1510 while in the neutral state of FIG. 15.

FIG. 17 represents an embodiment of third article of footwear 1504 as it responds to the application of a force corresponding to first rate 800 of pronation (see FIG. 8). In FIG. 17, it can be seen that first element 1510 of third article of footwear 1504 is substantially deformed, and is associated with a seventh degree of deformation 1710. In other words, the geometry of first element 1510 has been altered such that first element 1510 no longer comprises a cross-sectional teardrop-like shape. In some embodiments, as shown in FIG. 17, first element 1510 can become compressed such that it comprises a substantially crescent-like cross-sectional shape.

Furthermore, though first side 1606 retains an overall curvature that follows the curvature of interior cavity 106, first side 1606 is also substantially flattened and compressed relative to the cushioning system as illustrated in FIGS. 15 and 16. Furthermore, it can be seen that first element 1510 now has a seventh maximum thickness 1720 that is different from sixth thickness 1620. In FIGS. 16 and 17, seventh maximum thickness 1720 is substantially decreased relative to sixth thickness 1620. It should be understood that, in some embodiments, some bumps or irregularities may remain along first side 1606 while a force is applied. In addition, in some embodiments, some portions of first side 1606 may be more flattened than other portions, as the force or load that is applied may not be evenly distributed.

Thus, similar to the embodiments depicted earlier, a more rapid rate of pronation may elicit less deformation than a slower rate of pronation. Third rate 802 of FIG. 8, comprising a higher magnitude of force than first rate 800, can result in less compression and deformation of a cushioning element, as shown in FIG. 16. Similarly, a rate of pronation that is slower (as shown with respect to first rate 800 in FIG. 8)

may elicit a more pliable response from the material of cushioning system 1550 and lead to greater deformation and a larger decrease in thickness in some embodiments, as shown in FIG. 17.

The various illustrations of deformation of the material of third cushioning system 1550 shown can provide different sensory experiences for a user in different embodiments. As a cushioning element (e.g., first element 1510) is compressed during a particular rate of pronation, the cushioning element can respond by becoming increasingly rigid or stiff or by becoming increasingly yielding. In other words, in some embodiments, third cushioning system 1550 can contact or press against a foot (or a material such as a sock worn by the foot) and alter the user's tactile sensation. In some cases, such as when the rate of pronation is relatively higher (see FIG. 16), the cushioning system can produce a more noticeable sensation to a user. In one embodiment, the sensation can be more noticeable when the area of contact of the cushioning elements with the user are smaller, and/or resist the pressures of the user's foot, as shown above with respect to the rounded shape of the cushioning elements in FIGS. 15-17. In some embodiments, the curvature associated with third cushioning system 1550 can act as a specialized contact region that can provide different types of pressures against a user's foot. The sensation of the rounded surface of first element 1510 against a foot can prompt a user to modify their behavior in different embodiments, while the deformed, or flatter condition, can inform the user that the rate of pronation is in a desired range.

In some cases, the user can learn what rate causes the cushioning elements to yield and provide a more gentle response, and what rates cause the cushioning elements to become rigid and provide a stiffer response. In some embodiments, this tactile information may allow a user to learn to maintain a desired rate of pronation over time. Furthermore, the article may be removed or utilized as required. Third cushioning 1550 system may thus provide a gentle alert to the wearer to assume a correct, healthier, or improved pronation rate and/or range throughout various movements and positions. The feel of the different cushioning elements against a foot can also continuously serve to remind the wearer to maintain the healthier gait cycle.

It should be understood that although the discussion herein is primarily directed to the management of the rate of pronation, the same embodiments and disclosure are applicable to providing tactile feedback to lessen the range or degree of pronation (see FIG. 7). Furthermore, portions of an article of footwear and/or cushioning system as described herein may be configured to reduce the extent of pronation by restricting the range with which a foot may rotate within the article.

In addition, a cushioning system of the disclosed embodiments may comprise any layer or element of the upper and/or sole structure, and be configured as desired. In particular, layers or portions of the upper or sole structure may have any design, shape, size, and/or color. For example, some embodiments of the sole structure may include other materials disposed within the sole member, such as air bladders, leather, synthetic materials (such as plastic or synthetic leather), mesh, foam, or a combination thereon. In addition, specific regions of an article of footwear may be formed from different materials depending upon the anticipated forces experienced by each region.

Thus, the various cushioning elements as described here can provide an article of footwear with specialized responses to the behavior of a wearer. In one embodiment, the reaction forces can be more concentrated in the medial side of a foot than along the lateral side of a foot, thereby reducing the probability that the foot will over-pronate, or impart greater resistance to eversion and inversion of the foot.

In some embodiments, the use of cushioning elements in orthotics for an article of footwear can help support weakened areas of a foot and assist the user in each step. While a relatively rigid material, as may be included in a custom sole member, can provide functional support to the foot, softer or more flexible responses associated with the dynamic cushioning system described herein can absorb the loads experienced by the foot and provide protection. Such softer or cushioned regions can better absorb the loads placed on a foot, increase stabilization, and take pressure off uncomfortable or sore spots of the feet.

Other embodiments or variations of cushioning systems as disclosed herein may include other cushioning element patterns or various combinations of the above-disclosed designs. It should be noted that the present description is not limited to cushioning elements having the geometry or arrangement configurations of first cushioning system 250, second cushioning system 1250, and third cushioning system 1550. In different embodiments, each cushioning system may include further variations not depicted in the figures. Some variations may include differences in shape, size, contour, elevations, depressions, curvatures, and other variations of the cushioning system. In other words, the cushioning systems depicted herein are merely intended to provide an example of the many types of cushioning element-based configurations that fall within the scope of the present discussion.

While various embodiments have been described, the description is intended to be exemplary, rather than limiting, and it will be apparent to those of ordinary skill in the art that many more embodiments and implementations are possible that are within the scope of the embodiments. Although many possible combinations of features are shown in the accompanying figures and discussed in this detailed description, many other combinations of the disclosed features are possible. Any feature of any embodiment may be used in combination with or substituted for any other feature or element in any other embodiment unless specifically restricted. Therefore, it will be understood that any of the features shown and/or discussed in the present disclosure may be implemented together in any suitable combination. Accordingly, the embodiments are not to be restricted except in light of the attached claims and their equivalents. Also, various modifications and changes may be made within the scope of the attached claims.

What is claimed is:

1. An article of footwear comprising:

an upper, the upper including at least a first layer;

a sole structure joined to the upper;

the upper at least partially forming an interior cavity of the article of footwear;

the upper comprising a forefoot portion, a heel portion, a medial side, and a lateral side;

a cushioning system comprising at least one cushioning element;

the at least one cushioning element being disposed adjacent to the upper along the medial side of the upper and extending partway across the sole structure from the medial side to the lateral side;

the at least one cushioning element comprising an adjustable thickness in response to the application of a force;

wherein the at least one cushioning element includes a dynamically responsive material that exhibits dilatant behavior in response to an application of the force; and wherein the at least one cushioning element protrudes from the sole structure into the interior cavity above a surface of the sole structure.

2. The article of footwear according to claim 1, wherein the at least one cushioning element includes a first cushioning element disposed adjacent to the upper and a second cushioning element spaced apart from the first cushioning element and is disposed adjacent to the sole structure between the medial side and the lateral side of the upper, and wherein the second cushioning element includes the dynamically responsive material that exhibits dilatant behavior in response to the application of the force.

3. The article of footwear according to claim 1, wherein the at least one cushioning element includes a shear thickening fluid.

4. The article of footwear according to claim 1, wherein the at least one cushioning element is inward of an innermost layer of the upper and has a first surface with undulations extending into the interior cavity.

5. The article of footwear according to claim 1, wherein an application of a first force deforms the at least one cushioning element to a greater extent than the application of a second force when the second force is larger than the first force.

6. The article of footwear according to claim 1, wherein the at least one cushioning element is a first cushioning element that comprises a substantially teardrop-like cross-sectional shape.

7. The article of footwear according to claim 1, wherein the cushioning system increases in width along the medial side of the upper from an uppermost extent of the cushioning system to the sole structure, and increases in width along the sole structure from a lateral-most extent of the cushioning system to the medial side of the upper.

8. An article of footwear comprising:

an upper and a sole structure joined to the upper, the upper forming an interior cavity of the article of footwear;

a pronation feedback system comprising an array of cushioning elements spaced apart from one another, including a first cushioning element located adjacent to the upper along a medial side of the upper, and the array of cushioning elements extending partway across the sole structure from the medial side to a lateral side of the upper;

the first cushioning element comprising a substantially pyramidal geometry having an apex that protrudes into the interior cavity from an inner surface of the medial side of the upper;

at least a portion of the pronation feedback system comprising an adjustable thickness due to the inclusion of the first cushioning element; and wherein the first cushioning element includes a dynamically responsive material that exhibits dilatant behavior in response to an application of a force.

9. The article of footwear according to claim 8, wherein the first cushioning element includes a substantially smooth base end and a tapered end, wherein the substantially smooth base end is disposed closer to the inner surface of the upper relative to the tapered end.

10. The article of footwear according to claim 9, wherein the tapered end is configured to deform at a first strain rate in response to a first force and wherein the tapered end is configured to deform at a second strain rate in response to a second force, wherein the first strain rate is greater than the second strain rate when the first force is less than the second force.

11. The article of footwear according to claim 8, wherein the pronation feedback system includes a second cushioning element attached to the sole structure, and wherein the second cushioning element comprises the dynamically responsive material that exhibits dilatant behavior in response to the application of the force.

12. The article of footwear according to claim 11, wherein the second cushioning element comprises a smaller volume than the first cushioning element.

13. The article of footwear according to claim 8, wherein the first cushioning element comprises a shear thickening fluid.

14. The article of footwear according to claim 8, wherein the array of cushioning elements increases in width along the medial side of the upper from an uppermost extent of the array to the sole structure, and increases in width along the sole structure from a lateral-most extent of the array to the medial side of the upper.

15. An article of footwear comprising:

an upper and a sole structure joined to the upper, the upper forming an interior cavity of the article of footwear;

a cushioning system comprising a first cushioning element and a second cushioning element spaced apart from the first cushioning element;

the first cushioning element disposed adjacent to the upper and extending from the upper into the interior cavity formed by the upper, the second cushioning element disposed on the sole structure and protruding from the sole structure into the interior cavity above a surface of the sole structure;

the first cushioning element comprising a first region of adjustable thickness, and the second cushioning element comprising a second region of adjustable thickness; and the first cushioning element and the second cushioning element each include a dynamically responsive material that exhibits dilatant behavior in response to an application of force.

16. The article of footwear according to claim 15, further comprising a third cushioning element disposed along the upper and extending into the interior cavity, wherein the third cushioning element is spaced apart from the first cushioning element and the second cushioning element, and wherein the third cushioning element comprises a third region of adjustable thickness.

17. The article of footwear according to claim 15, wherein a first rate of pronation by a user is associated with a first level of deformation of the first cushioning element, wherein a second rate of pronation by the user is associated with a second level of deformation of the first cushioning element, and wherein the first level of deformation is greater than the second level of deformation when the first rate of pronation is less than the second rate of pronation.

18. The article of footwear according to claim 15, wherein the first cushioning element comprises a round geometry with a first surface protruding into the interior cavity.

19. The article of footwear according to claim 15, wherein the first cushioning element comprises a pyramidal geometry having an apex that protrudes into the interior cavity.

* * * * *